US007473076B2

(12) United States Patent
Rosenkranz et al.

(10) Patent No.: US 7,473,076 B2
(45) Date of Patent: Jan. 6, 2009

(54) CONTROL METHOD AND CONTROL SYSTEM FOR A CONTROLLABLE PITCH MARINE PROPELLER

(75) Inventors: Hans-Gunther Rosenkranz, Wantirna South (AU); Martin Robson, Tyabb (AU)

(73) Assignee: Aimbridge Pty Ltd., Melbourne (AU)

( * ) Notice: Subject to any disclaimer, the term of this patent is extended or adjusted under 35 U.S.C. 154(b) by 476 days.

(21) Appl. No.: 10/573,934

(22) PCT Filed: Sep. 6, 2004

(86) PCT No.: PCT/AU2004/001204

§ 371 (c)(1),
(2), (4) Date: Mar. 28, 2006

(87) PCT Pub. No.: WO2005/044659

PCT Pub. Date: May 19, 2005

(65) Prior Publication Data

US 2007/0134092 A1 Jun. 14, 2007

Related U.S. Application Data

(60) Provisional application No. 60/519,769, filed on Nov. 12, 2003.

(30) Foreign Application Priority Data

Oct. 28, 2003 (AU) ..... 2003905952

(51) Int. Cl.
*B63H 3/06* (2006.01)

(52) U.S. Cl. ..... 416/1; 416/25

(58) Field of Classification Search ..... None
See application file for complete search history.

(56) References Cited

U.S. PATENT DOCUMENTS

| | | | | |
|---|---|---|---|---|
| 6,379,114 | B1 * | 4/2002 | Schott et al. | 416/1 |
| 6,511,354 | B1 | 1/2003 | Gonring et al. | 440/87 |

FOREIGN PATENT DOCUMENTS

| | | |
|---|---|---|
| EP | 1 008 514 | 6/2000 |
| JP | 8239093 | 9/1996 |
| SU | 787266 | 12/1980 |

* cited by examiner

*Primary Examiner*—Richard Edgar
(74) *Attorney, Agent, or Firm*—Bromberg & Sunstein LLP

(57) ABSTRACT

A control method and system for a controllable pitch marine propeller including operating modes comprised of a maneuvering mode and a cruise mode and check modes comprised of an engine check mode and propeller check mode. The cruise mode provides for wide open throttle acceleration and power stop. Smooth transition sub-modes are provided for providing smooth transition between cruise mode and maneuvering mode and vice versa. The system operates by a lever (28) which controls a pitch control unit (10) which in turn controls engine speed and also the pitch of propeller blades (12) of propeller (14). Thus, dependent on the position of the control lever (28) in either maneuvering mode or cruise mode, an appropriate engine speed and propeller pitch is selected automatically for driving a watercraft.

29 Claims, 10 Drawing Sheets

CONTROL METHOD AND CONTROL SYSTEM FOR A CONTROLLABLE PITCH MARINE PROPELLER

CROSS-REFERENCED APPLICATIONS

This application claims priority from U.S. Provisional Application 60/519,769 filed 12 Nov. 2003, and Australian Provisional Patent Application 2003905952 filed 28 Oct. 2003.

FIELD OF THE INVENTION

This invention relates to a method and system for controlling the pitch of a controllable pitch marine propeller and to a vessel including the system.

DESCRIPTION OF THE PRIOR ART

Controllable pitch marine propellers are known and include a propeller hub having a plurality of propeller blades which are mounted for movement about axes extending perpendicular to the rotation axis of the hub. The propeller hub is driven by an engine to rotate the hub. A pitch control mechanism is used to change the pitch of the propeller blades to suit various operating conditions of the engine to improve boat performance and also to improve economy.

Our earlier International Application No. PCT/AU99/00276 and International Application No. PCT/AU2004/000970 describe mechanisms for enabling the pitch of the propeller blades to be adjusted. Whilst the mechanisms in the two aforesaid applications are different, they both include a motor which is controlled to move a control shaft to adjust the position of the blades. The control shaft movement can be a relative rotation of a control shaft relative to a main drive shaft, or a longitudinal movement of the control shaft. Furthermore, other control systems such as hydraulic systems can also be used.

SUMMARY OF THE INVENTION

The invention may be said to reside in a method of controlling the pitch of a controllable pitch marine propeller of a watercraft, comprising the steps of:

providing a cruise mode in which engine speed and pitch of the propeller are adjusted to enable the speed of advance of the watercraft to be varied, and wherein the engine speed is adjustable up to a maximum engine speed;

providing a manoeuvring mode in which the pitch of the marine propeller is adjusted whilst maintaining engine speed within a predetermined limit less than the maximum engine speed;

providing an engine check mode in which the engine can be revved without drive being supplied to the propeller; and providing a pitch check mode in which the pitch of the propeller can be adjusted without rotating the propeller.

In one embodiment of the invention the method includes providing one or more selectors to select the manoeuvring mode, the cruise mode, the engine check mode or the pitch check mode, and a drive actuator for movement between extreme positions so that in the manoeuvring mode, movement of the drive actuator changes the pitch of the propeller whilst limiting engine speed, and in cruise mode, movement of the drive actuator changes engine speed and pitch of the propeller.

In one embodiment of the invention, the step of providing the manoeuvring mode maintains engine speed substantially constant at a speed equal to or less than the said predetermined limit.

In another embodiment of the invention, the step of providing the manoeuvring mode comprises adjusting the engine speed whilst also adjusting the pitch of the propeller.

Preferably the predetermined limit is about 30% of maximum engine speed.

Preferably the method includes providing a transition mode routine so that, should the mode be changed between manoeuvring mode and cruise mode, a smooth transition occurs to prevent unwanted response from the watercraft due to the position of the drive actuator at the time of change between the manoeuvring mode and the cruise mode.

Preferably the method further includes providing sub routines when in the cruise mode, to determine wide open throttle condition required by a watercraft operator, normal cruise condition in which engine speed or watercraft speed is adjusted in accordance with the position of the drive actuator to achieve best fuel efficiency, and power stop condition in which the pitch of the propeller is adjusted into a full reverse position with engine power available throughout the transition from forward movement of the watercraft to a stopped condition of the watercraft or until the watercraft is controlled to again advance.

In one embodiment of the invention the method comprises maintaining the power stop condition for a predetermined time period, or until the watercraft is controlled to again advance.

In one embodiment the method includes, when in the power stop routine, monitoring watercraft speed.

In this embodiment the watercraft speed is approximated from the equation:

$$\text{speed}=\text{pitch amount}\times\text{propeller rotation speed}-\text{slip}$$

The watercraft speed may be presented by way of a look-up table so that for particular pitch amounts and propeller speeds, an appropriate speed value is provided.

The invention may be said to reside in a system for controlling the pitch of a controllable pitch marine propeller of a watercraft, comprising:

a controller for:

(a) providing a cruise mode in which engine power and pitch of the propeller are adjusted to enable the watercraft to cruise, and wherein the engine speed is adjustable up to a maximum engine speed;

(b) providing a manoeuvring mode in which the pitch of the marine propeller is adjusted whilst maintaining engine speed within a predetermined limit less than the maximum engine speed;

(c) providing an engine check mode in which the engine can be revved without drive being supplied to the propeller; and (d) providing a pitch check mode in which the pitch of the propeller can be adjusted without rotating the propeller.

In one embodiment of the invention the system includes providing one or more selectors for selecting the manoeuvring mode, the cruise mode, the engine check mode or the pitch check mode, and a drive actuator for movement between extreme positions so that in the manoeuvring mode, movement of the drive actuator changes the pitch of the propeller whilst maintaining engine speed substantially constant, and in cruise mode, movement of the drive actuator changes engine speed and pitch of the propeller.

Preferably the controller is also for providing a transition mode routine so that, should the mode be changed between manoeuvring mode and cruise mode, a smooth transition occurs to prevent unwanted response from the boat due to the position of the drive actuator at the time of change between the manoeuvring mode and the cruise mode.

Preferably the controller is also for providing sub routines when in the cruise mode to determine wide open throttle condition required by a watercraft operator, normal cruise condition in which watercraft speed is adjusted in accordance with the position of the control lever, and power stop condition in which the pitch of the propeller is adjusted into a full reverse position with engine power available throughout the transition from forward movement of the watercraft to a stopped condition of the watercraft or until the watercraft is controlled to again advance.

In one embodiment of the invention the controller maintains the power stop condition for a predetermined time period, or until a watercraft is controlled to again advance.

In one embodiment the system includes a speed sensor for monitoring watercraft speed when in the power stop routine.

In another embodiment, the watercraft speed is approximated from the equation:

$$\text{speed}=\text{pitch amount}\times\text{propeller rotation speed}-\text{slip}$$

The equation may be presented by way of a look-up table so that for particular pitch amounts and propeller rotation speeds, an appropriate speed value which is adjusted for slip is provided.

The invention also provides a system for controlling the pitch of a controllable pitch marine propeller of a watercraft having an engine, comprising:

a drive actuator for manual movement by a watercraft operator of the watercraft;

a controller for controlling engine power and pitch of the marine propeller;

a mode selector for selecting a cruise mode or a manoeuvring mode for the watercraft; and wherein the controller is also for receiving control signals from the mode selector and from the drive actuator, and when the mode selector is actuated to place the watercraft in the manoeuvring mode, the controller limits engine rpm speed to within a predetermined value less than maximum engine speed and controls the pitch of the propeller blades in accordance with the manual movement of the drive actuator by the watercraft operator to change watercraft speed, and when the mode selector is in the cruise mode, the controller sets engine power up to the maximum engine speed and propeller pitch in accordance with movement of the drive actuator by the watercraft operator to change watercraft speed.

In one embodiment of the invention, the controller when in the manoeuvring mode maintains engine speed substantially constant at a speed equal to or less than the said predetermined limit.

In another embodiment of the invention, the controller when in the manoeuvring mode comprises adjusting the engine speed whilst also adjusting the pitch of the propeller.

Preferably the predetermined limit is about 30% of maximum engine speed.

Preferably the controller comprises a pitch control unit which controls engine power by selecting an output for supply to the engine from a look up table dependent upon the manually adjusted position of the drive actuator, and a pitch motor controller for receiving outputs from the pitch control unit to adjust the pitch of the propeller.

Preferably the system includes a pitch control motor for adjusting the pitch of the propeller and the pitch motor controller is for supplying an output signal to the pitch control motor to actuate the pitch control motor to adjust the propeller to the desired pitch.

Preferably the system includes a sensor for providing a measure of the pitch of the propeller blades, the sensor being coupled to the pitch control unit so the pitch control unit is provided with a signal indicative of the pitch of the propeller.

Preferably the watercraft includes a clutch for selectively disconnecting power from the engine to the propeller or enabling power to be supplied from the engine to the propeller, a clutch actuator connected to the clutch and the pitch control unit being for supplying a control signal to the actuator to open or close the clutch.

Preferably the system includes a clutch position monitoring sensor for providing a signal indicative of whether the clutch is in the open or closed position, the sensor being connected to the pitch control unit.

In one embodiment the engine includes an rpm sensor for sensing engine speed, the rpm sensor being connected to the pitch control unit.

In one embodiment a speed measuring device is provided and connected to the pitch control unit for supplying a signal indicative of the speed of the watercraft to the pitch control unit.

In another embodiment the speed unit is a GPS speed measuring system.

In the preferred embodiment, the over-the-ground watercraft speed is approximated from the equation:

$$\text{speed}=\text{pitch amount}\times\text{propeller rotation speed}-\text{slip}$$

The equation may be presented by way of a look-up table so that for particular pitch amounts and rpms, an appropriate speed value which is adjusted for slip is provided.

Preferably the mode selector comprises at least one switch for selectively placing the watercraft into the manoeuvring mode or the cruise mode.

Preferably a second switch is provided for placing the watercraft into a pitch check mode or an engine check mode.

Preferably the switches are momentary contact switches to place the system in the cruise mode or manoeuvring mode, and the pitch check mode or engine check mode by causing modes to toggle between the cruise mode and manoeuvring mode, and pitch check mode and engine mode.

Preferably the system includes a clutch engage actuator for actuation by the watercraft operator so the pitch control unit can be overriden if attempting to open the clutch to maintain the clutch in a closed position so power is delivered from the engine to the propeller.

Preferably the system includes a propeller stop element for actuation by the watercraft operator to perform an emergency stop of the propeller, the propeller stop element being connected to the pitch control unit so that upon actuation of the propeller stop element, the pitch control unit reduces engine speed and opens the clutch to shut off rotary power from the engine to the propeller, and adjust the position of the propeller to neutral position.

Preferably the pitch control unit, when the pitch check-engine check mode switch is actuated, causes the clutch to open so that drive is not supplied from the engine to the propeller and in the engine check mode position, the pitch control unit outputs a signal to the engine to cause the engine to rev in accordance with the position of the drive actuator, as controlled by the watercraft operator, and when in the pitch check mode position, causes a signal to be output to the pitch motor controller and then to the pitch motor to adjust the pitch of the propeller dependent on the movement of the drive actuator.

Preferably the pitch control unit includes a look up table of values for output to the pitch motor controller dependent upon the position of the drive actuator so that an appropriate value is selected for supply to the pitch motor controller to in turn control the pitch motor to adjust the pitch of a propeller to a position dependent on the position of the drive actuator.

Preferably the drive actuator is a control lever moveable between a full forward position to a full reverse position.

The invention may also be said to reside in a method of controlling the pitch of a controllable pitch marine propeller of a watercraft which has an engine, comprising the steps of:

providing a cruise mode in which engine power and propeller pitch position is adjusted by manual operation of a drive actuator so the engine power is increased or decreased to drive the watercraft by rotation of the propeller and adjusting of the pitch of the propeller to achieve a required watercraft speed, the engine speed being adjustable up to a maximum engine speed;

providing a manoeuvring mode in which engine speed is limited to less than the maximum engine speed and propeller pitch is adjusted by manual control of a drive actuator by the watercraft operator to enable the boat to be manoeuvred by pitch control of the propeller which varies the speed of the watercraft; and providing a transition mode so that when the mode is changed from the cruise mode to the manoeuvring mode, or from the manoeuvring mode to the cruise mode, engine speed and propeller pitch are not changed in an undesirable fashion upon change between the modes if the location of the manually controlled drive actuator is in such a position which would otherwise cause the watercraft to respond in an undesirable manner.

Preferably a single drive actuator is provided for changing watercraft speed when in the cruise mode, and changing propeller pitch when in the manoeuvring mode.

Preferably the transition mode determines whether the drive actuator position is beyond a predetermined limit: and sets a predetermined engine speed and adjusts the pitch of the propeller dependent upon watercraft speed.

Preferably the transmission mode still further comprises preventing the watercraft from operating in manoeuvring mode and in such time as the drive actuator is manually adjusted by the watercraft operator to a position which matches engine speed and pitch of the propeller and thereafter continued movement of the drive actuator enables the watercraft operator to drive the watercraft in cruise mode by movement of the drive actuator.

In one embodiment of the invention, the step of providing the manoeuvring mode maintains engine speed substantially constant at a speed equal to or less than the said predetermined limit.

In another embodiment of the invention, the step of providing the manoeuvring mode comprises adjusting the engine speed whilst also adjusting the pitch of the propeller.

Preferably the predetermined limit is about 30% of maximum engine speed.

The invention may also be said to reside in a system for controlling the pitch of a controllable pitch marine propeller of a watercraft which has an engine, comprising:

a controller for:

(a) providing a cruise mode in which engine power and propeller pitch is adjusted by manual operation of a drive actuator so the engine power is increased or decreased between maximum and minimum engine speeds to drive the watercraft by rotation of the propeller and adjusting of the pitch of the propeller to achieve a required watercraft speed;

(b) providing a manoeuvring mode in which engine speed is limited to a limited speed less than the maximum engine speed and propeller pitch is adjusted by manual control of a drive element by the watercraft operator to enable the boat to be manoeuvred by pitch control of the propeller which varies the speed of the watercraft; and (c) providing a transition mode so that when the mode is changed from the cruise mode to the manoeuvring mode, or from the manoeuvring mode to the cruise mode, engine speed and propeller pitch are not changed in an undesirable fashion upon change between the modes if the location of the manually controlled drive actuator is in such a position upon change of the mode so that the boat does not respond in an undesirable manner.

In one embodiment of the invention, the controller when in the manoeuvring mode maintains engine speed substantially constant at a speed equal to or less than the said predetermined limit.

In another embodiment of the invention, the controller when in the manoeuvring mode comprises adjusting the engine speed whilst also adjusting the pitch of the propeller.

Preferably the predetermined limit is about 30% of maximum engine speed.

Preferably a single drive actuator is provided for changing engine speed when in the cruise mode, and changing propeller pitch when in the manoeuvring mode.

Preferably the transition mode determines whether the drive actuator position is beyond a predetermined limit and sets a predetermined engine speed and adjusts the pitch of the propeller dependent upon watercraft speed.

Preferably the method further includes when in the transition mode preventing the watercraft from operating in cruise mode until such time as the watercraft operator moves the drive actuator to a position which matches the engine speed and pitch of the propeller.

Preferably the method also includes monitoring watercraft speed and setting engine power as a function of the engine speed whilst controlling the pitch of the propeller to maintain that watercraft speed when transitioning from manoeuvring mode to cruise mode.

Preferably the method includes monitoring watercraft speed and setting engine speed to a predetermined speed and propeller pitch to a pitch dependent on watercraft speed when transitioning from cruise mode to manoeuvring mode.

The invention still further provides a method for controlling the pitch of a controllable pitch marine propeller of a watercraft which has an engine, comprising the steps of:

providing a power stop mode for rapidly reducing speed of the watercraft when the watercraft is advancing; and adjusting the pitch of the propeller into a full reverse position with engine power being available throughout the transition from advancing movement of the watercraft to a reduced forward speed of the watercraft.

Preferably the method includes maintaining continuous engine power available until the watercraft stops or until the watercraft is controlled by a watercraft operator. Thus, this aspect enables the watercraft to be completely stopped under power stop conditions or if during the course of stopping the operator decides that it would be desirable to accelerate the watercraft the drive can do so under driver control.

Preferably the method includes determining a power stop requirement by monitoring the speed of movement of a drive actuator to place the propeller in a full reverse pitch position.

Preferably the method includes monitoring watercraft speed and maintaining the watercraft in power stop mode until the watercraft reaches a predetermined speed or is controlled by an operator by movement of an actuating device to operate the boat other than in power stop mode.

In one embodiment of the invention the method comprises maintaining the power stop condition for a predetermined time period, or until a watercraft is controlled to again advance.

In one embodiment of the invention, the step of providing the manoeuvring mode maintains engine speed substantially constant at a speed equal to or less than the said predetermined limit.

In another embodiment of the invention, the step of providing the manoeuvring mode comprises adjusting the engine speed whilst also adjusting the pitch of the propeller.

Preferably the predetermined limit is about 30% of maximum engine speed.

The invention also provides a system for controlling the pitch of a controllable pitch marine propeller of a watercraft which includes an engine, comprising:

a drive actuator moveable from a forward position to a reverse position;

a controller for adjusting the pitch of the propeller to place the pitch in a fully reverse position; and wherein the controller is for determining the requirement for power stop by monitoring movement of the actuator and for, upon determination of power stop, adjusting the pitch of the propeller to the full reverse position with engine power available throughout the transition from forward movement of the watercraft to a reduced speed of the watercraft.

Preferably the controller is for maintaining continuous engine power until the watercraft stops or the actuator is moved by the watercraft operator.

Preferably the controller is for determining the requirement for power stop by monitoring the speed of movement of the actuator to the full reverse position.

Preferably the drive actuator comprises a control lever.

In one embodiment the system includes a speed sensor for providing a signal indicative of speed of the watercraft and the controller is for maintaining the watercraft in power stop mode until a predetermined watercraft speed is reached or the drive actuator is actuated by an operator to operate the watercraft in other than power stop mode.

In one embodiment, the watercraft speed is approximated from the equation:

$$\text{speed}=\text{pitch amount}\times\text{propeller rotation speed}-\text{slip}$$

The watercraft speed may be presented by way of a look-up table so that for particular pitch amounts and rpms, an appropriate speed value is provided.

The invention also provides a method of controlling the pitch of a controllable pitch marine propeller of a watercraft which includes an engine, comprising:

providing an indication of the speed of the watercraft;

using the speed of the watercraft to control engine power dependent on any one or more of the parameters selected from the following group of parameters: propeller pitch, and operating mode of the water craft.

In one embodiment, the operating mode is a set cruise control mode in which it is desired to maintain the watercraft speed at a constant speed and wherein engine power is adjusted to maintain that constant speed.

In another embodiment, the operating mode includes a power stop mode in which watercraft speed is used to determine when watercraft speed drops to a predetermined minimum speed so that power stop mode continues, unless otherwise overridden by operator control, until the minimum watercraft speed is produced.

In this embodiment, the engine speed also is used to set the power of the engine at the commencement of power stop so that a particular engine power is selected dependent on the speed of the watercraft.

Preferably the operating mode includes transition modes which are implemented when the operating mode of the watercraft is changed between a cruise mode and a manoeuvring mode, and wherein the engine power is selected dependent on the boat speed during transition between the cruise mode and the manoeuvring mode to produce a smooth transition between the cruise mode and manoeuvring mode.

Preferably the watercraft speed is used to produce the smooth transition when transitioning from both the cruise mode to the manoeuvring mode and from the manoeuvring mode to the cruise mode.

In one embodiment, the watercraft speed is approximated from the equation:

$$\text{speed}=\text{pitch amount}\times\text{propeller rotation speed}-\text{slip}$$

The watercraft speed may be presented by way of a look-up table so that for particular pitch amounts and rpms, an appropriate speed value is provided.

The invention also provides a system for controlling the pitch of a controllable pitch marine propeller of a watercraft which includes an engine, comprising:

a speed means for providing an output indicative of the speed of the watercraft; and a controller for using the output to control engine power dependent on any one or more of the parameters selected from the following group of parameters: propeller pitch, and operating mode of the water craft.

In one embodiment, the operating mode is a set cruise control mode in which the controller maintains the watercraft speed at a constant speed and wherein engine power is adjusted to maintain that constant speed.

In another embodiment, the operating mode includes a power stop mode in which the output is used to determine when watercraft speed drops to a predetermined minimum speed so that power stop mode continues, unless otherwise overridden by operator control, until the minimum watercraft speed is produced.

In one embodiment of the invention the method comprises maintaining the power stop condition for a predetermined time period, or until a watercraft is controlled to again advance.

In this embodiment, the engine speed also is used to set the power of the engine at the commencement of power stop so that a particular engine power is selected dependent on the output indicative of speed of the watercraft.

Preferably the operating mode includes transition modes which are implemented when the operating mode of the watercraft is changed between a cruise mode and a manoeuvring mode, and wherein the engine power is selected dependent on the output during transition between the cruise mode and the manoeuvring mode to produce a smooth transition between the cruise mode and manoeuvring mode.

Preferably the output is used by the controller to produce the smooth transition when transitioning from both the cruise mode to the manoeuvring mode and from the manoeuvring mode to the cruise mode.

BRIEF DESCRIPTION OF THE DRAWINGS

A preferred embodiment of the invention will be described, by way of example, with reference to the accompanying drawings in which.

DETAILED DESCRIPTION OF THE PREFERRED EMBODIMENT

Figure 1:
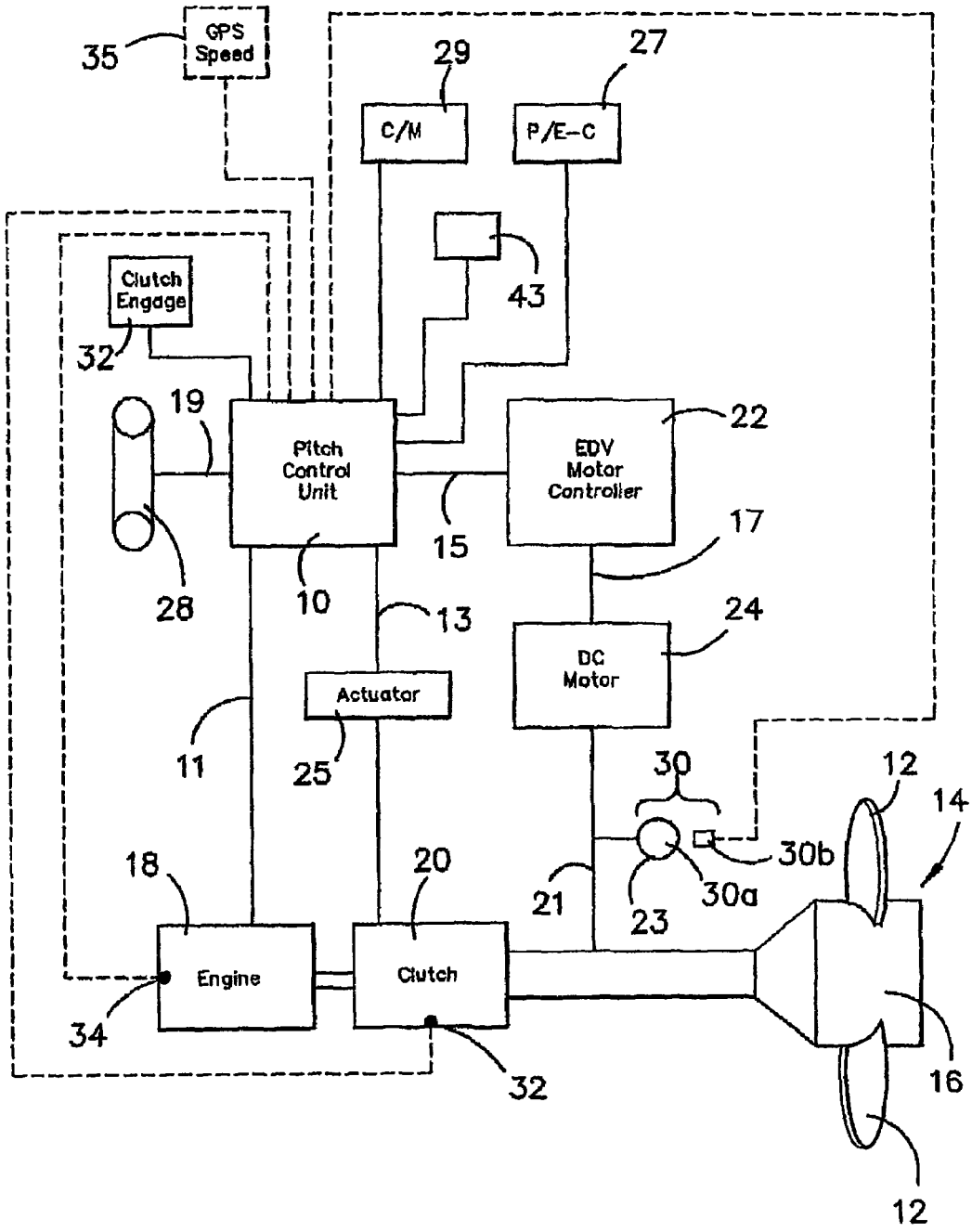
FIG. 1 is a schematic view of a control system for controlling the pitch of a marine propeller.

With reference to FIG. 1 a schematic view of a control system according to the preferred embodiment, and a marine drive system for a boat is shown. The marine drive system generally comprises an engine 18 which drives a propeller 14 via a clutch 20. The propeller 14 includes a hub 16 and propeller blades 12. In a variable pitch marine propeller, the blades 12 are mounted so that the position of the blades 12 can be adjusted about axes transverse to the rotational axis of the hub 16.

The control system includes a pitch control unit 10. The pitch control unit 10 is connected to an EDU motor controller 22 which in turn controls a DC motor 24 which adjusts the pitch of the propeller blades 12. For the mechanical details of the mechanism, regard can be had to the aforementioned International applications, the contents of which are incorporated into this specification by this reference.

The pitch control unit 10 controls the engine 18 by control signals which are output on line 11. Basically the control is a control over the fuel delivery system of the engine 18 to increase or decrease the power supplied by the engine 18 in response to movement of a control lever 28 to control boat speed. The pitch control unit 10 is also connected to a clutch actuator 25 by line 13 so that signals can be output to the actuator 25 to cause the actuator to open or close the clutch 20. Obviously when the clutch is open, drive to the propeller 14 from the engine 18 is disconnected and when the clutch 20 is closed, the engine 18 is able to drive the propeller 14. The pitch control unit 10 is also connected to the EDU motor controller 22 by line 15 so that signals can be output to the controller 22 to in turn cause the controller 22 to output signals on line 17 to control the DC motor 24. Rotation of the DC motor 24 adjusts the pitch position of the propeller blades 12, and therefore the control signals provided on lines 15 and 17 are used to actuate the DC motor 24 to position the propeller blades 12 in a desired pitch position depending on the operating conditions of the system, as will be described in more detail hereinafter. The control lever 28 is connected to the pitch control unit 10 and is moveable by a watercraft operator between extreme positions to drive the boat. In general, the signals output upon movement of the lever 28 are electronic signals which are supplied to the pitch control unit 10 via line 19 and those signals provide a control signal to the pitch control unit 10 indicative of the position of the lever 28 so the engine 18 is controlled in speed and/or torque dependent on the position of the lever 28.

A propeller blade pitch position sensor 30, a clutch open or close sensor 32, an engine rpm sensor 34, and a GPS system 35 for providing a measure of ground speed are also connected to the control unit 10. Thus, data is provided to the pitch control unit 10 concerning the pitch position of the propeller blades 12, whether the clutch 20 is open or closed, the engine speed of the engine 18, and the over the ground speed of the boat.

The pitch position sensor 30 is located to measure the movement of an output shaft 21 from the DC motor 24 which controls the position of the propeller blades 12. The sensor 30 is located in this position because of ease in measuring the pitch of the propeller by measuring the output shaft 21 of the motor rather than attempting to provide the sensor 30 in the hub 16. However, if desired the sensor could be provided in the hub 16.

The sensor 30 is preferably a Hall effect sensor and comprises a magnet 30*a* which is mounted on a worm wheel 23 of a worm drive which is driven by the output shaft 21. A sensor output 30*b* completes the sensor 30 and an output signal is produced when the worm wheel 23 rotates to such a position that the magnet 30*a* is adjacent the sensor output 30*b*, as is well known. In the preferred embodiment of the invention, the output shaft 21 of the motor 24 is rotated a large number of times, for example 120 revolutions, in order to drive the pitch of the propeller 14 from the reverse position to the full forward position. Those 120 revolutions rotate the worm wheel 23 no more than one full revolution, and preferably a complete revolution, so that when the magnet 30*a* is aligned with the sensor output 30*b*, the propeller blades 12 will be in a predetermined pitch position. Thus, in order to drive the propeller blades 12 until they are adjusted to the particular reference pitch position, the motor 21 is rotated until the signal is received from the sensor output 30*b*. Thereafter, the pitch is controlled by controlling the amount of revolutions of the output shaft 21 to further adjust the pitch of the propeller blades 12 from that reference position.

Figure 1A:
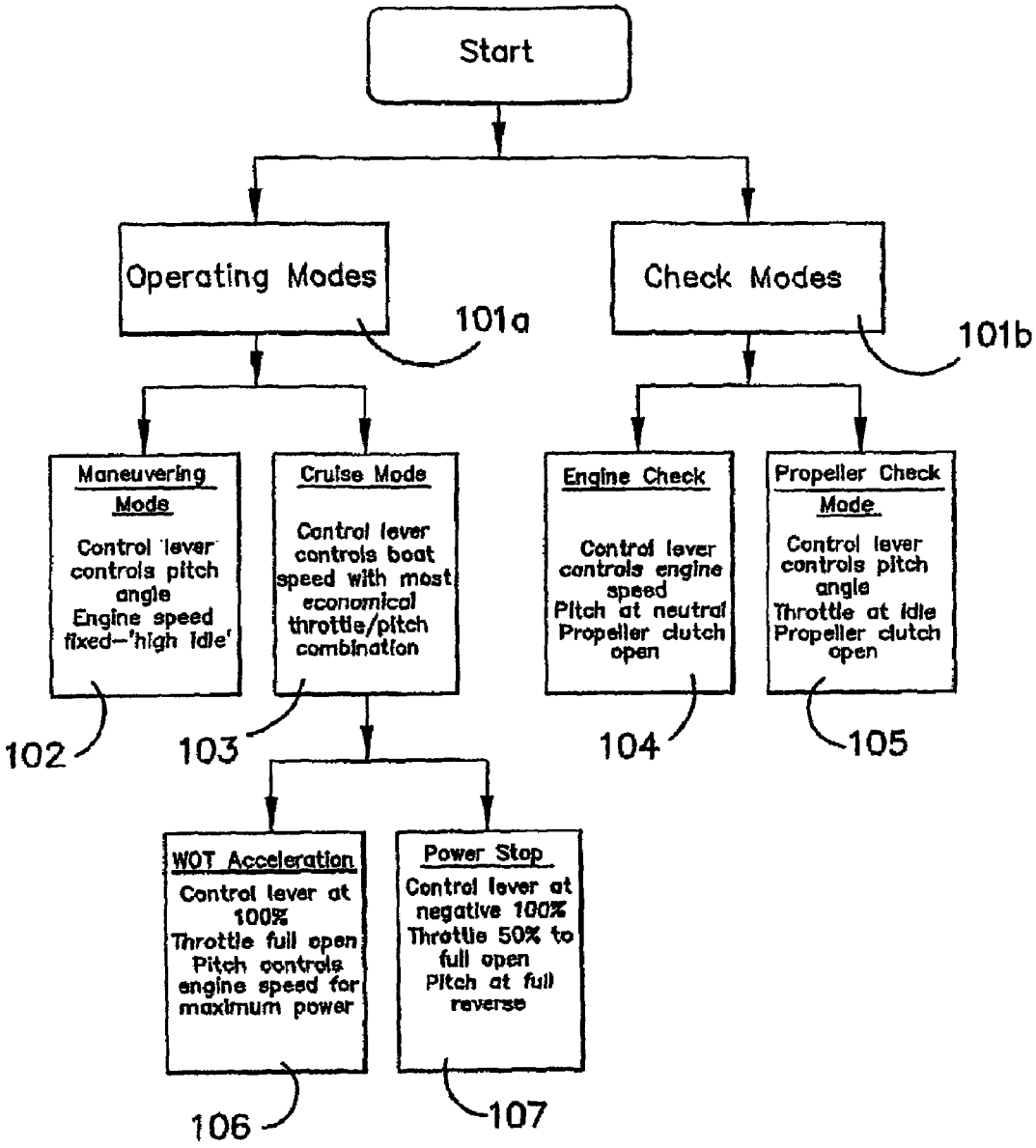
FIG. 1A is a diagram illustrating overall operation of the system described in FIG. 1.

FIG. 1A is an overall view of the operating system according to the preferred embodiment of the invention. The system operates by determining a particular mode of operation which a watercraft operator can select via a control panel which will be described with reference to FIG. 2. The modes generally comprise operating modes 101*a* or check modes 101*b*. The operating modes 101*a* are either a manoeuvring mode 102 or a cruise mode 103. The check modes 101*b* are an engine check mode 104 or a propeller check mode 105.

Figure 2:
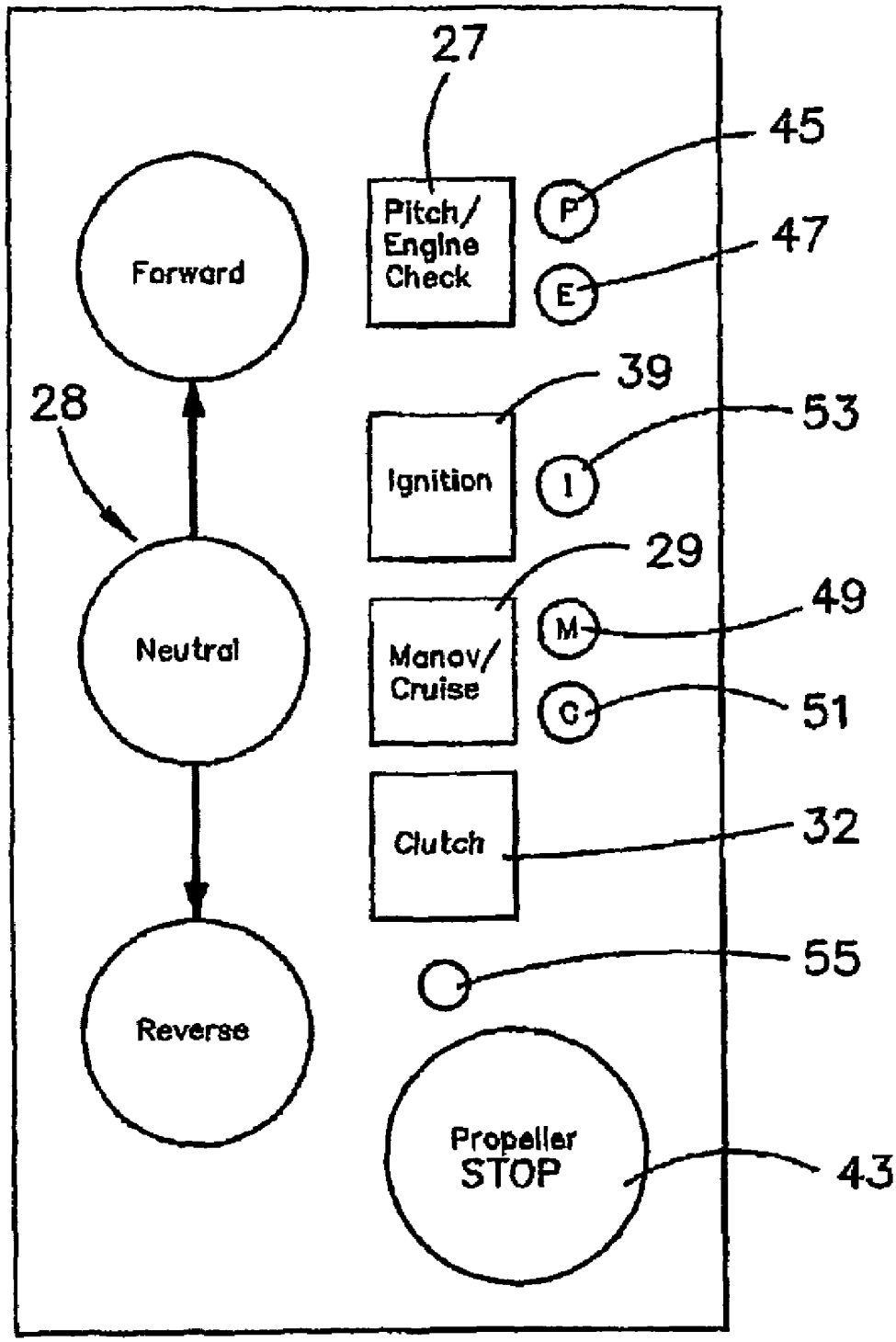
FIG. 2 is a diagram illustrating a control panel with which the system and method of the invention may be used.

The manoeuvring mode 102 is a mode in which a control lever 28, which will be described in more detail with reference to FIG. 2, is used to change the pitch of the propeller blades 12 whilst engine speed is limited to a speed below maximum engine speed. In this mode, movement of the control lever 28 influences the control unit 10 to change the pitch of the propeller blades 12 to enable the boat to be manoeuvred whilst arriving at or leaving a dock or the like. The control unit 10 varies engine power to maintain engine speed at, for example, a high idle.

In cruise mode, the control lever 28 provides a signal to pitch control unit 10 to control the engine 18 in cruise mode with the control lever position signaling to the control unit 10 the power requested by the operator. Thus, the control lever 28 influences the control unit 10 to set engine power (which may in turn alter engine speed) and propeller pitch to produce the required boat speed. The cruise mode 103 also enables the boat to travel in a wide open throttle mode 106 in which the engine throttle and pitch of the propeller blades are operated for maximum power. In cruise mode, the boat can also be placed into a power stop mode 107 in which the pitch of the propeller blades are moved to full reverse position and the throttle is reduced to somewhere between 50% to full open throttle.

The resolution of the pitch under the control of the control lever 28 is finer in the manoeuvring mode than in the cruise mode. In other words, in the cruise mode movement of the control lever 28 may vary the pitch from neutral to, for example 12 cm of pitch, whereas the same amount of movement of the control lever 28 in the manoeuvring mode will produce a much smaller amount of pitch for, example 100 mm (4 inches) of pitch. Thus, that movement of the control lever will result in a much lower boat speed because of the decreased amount of pitch in the manoeuvring mode. This is desirable because in the manoeuvring mode, the boat is obviously required to travel slowly for precise movement while approaching or leaving a dock, etc.

FIG. 2 is a diagram of a control panel which the watercraft operator of the boat will use in order to control the boat and, in particular, the pitch of the propeller blades 12 during various operational modes of the boat.

With reference to FIG. 2, the lever 28 is, as is well known, moveable between a forward, neutral and reverse position under the control of the boat operator. In a forward position, the lever 28 normally is requiring the engine to be revved so the boat can be driven forward. The pitch of the propeller blades are changed depending on the operational conditions of the boat to provide the best possible performance, depending on the number of people in the boat, sea conditions and the like. In the neutral position, the pitch of the propeller blades are set to a neutral location where rotation of the propeller 14 effectively produces no drive. In the reverse position, the pitch of the propeller blades are set in a reverse position so the boat can be driven backwards. Thus, reverse is possible without the use of a gear box to change the rotational direction of the propeller 14. The control panel also includes a pitch check and engine check mode switch 27, an ignition switch 39, a cruise/manoeuvre mode switch 29, and the clutch engage switch 32. The switches 27 and 29 are preferably in the form of contact switches (push buttons) so the system can be switched between engine check and pitch check mode with the switch 27 and cruise and manoeuvring modes with the switch 29. However, the switches could be replaced by other types of switches or be in the form of a scroll-down menu on a display screen (not shown) or the like for appropriate input to the pitch control unit 10, dependent on how the boat operator wishes to control the boat. The panel also includes an emergency propeller stop button 43. Light emitting diodes 45 and 47, and 49 and 51 are provided so that an indication of whether the system is in the manoeuvring mode, cruise mode, engine check mode or pitch check mode can be displayed for easy recognition by the boat operator. The ignition switch 39 is also usually provided with a light emitting diode or electrical globe 53 to show when the ignition is on and if a generator (not shown) is charging, and the clutch switch 32 is also provided with a light emitting diode 55 to show when the clutch is engaged. The light emitting diode 55 will be off when the clutch is engaged.

In normal operation of the boat, the ignition switch 39 is switched on under the control of a key or the like to start the engine. The boat is moved by moving the lever 28 forward or reverse from neutral so the hub 16 is rotated and the propeller 14 drives the boat through the water, as is well known. The pitch check and engine check mode switch 27 enables the boat operator to check engine operation by revving the engine and also check movement of the pitch of the propeller blades 12 to ensure that all seem to be operating correctly if the boat operator so desires. The manoeuvre and cruise switch 29 enables the boat operator to place the control system into a manoeuvre mode where the boat is manoeuvred by change in pitch of the propeller blades 12 and a cruise mode where the boat is driven in the most economic way under normal throttle conditions by engine speed which rotates the propeller 14 and suitable pitch.

Figure 3:
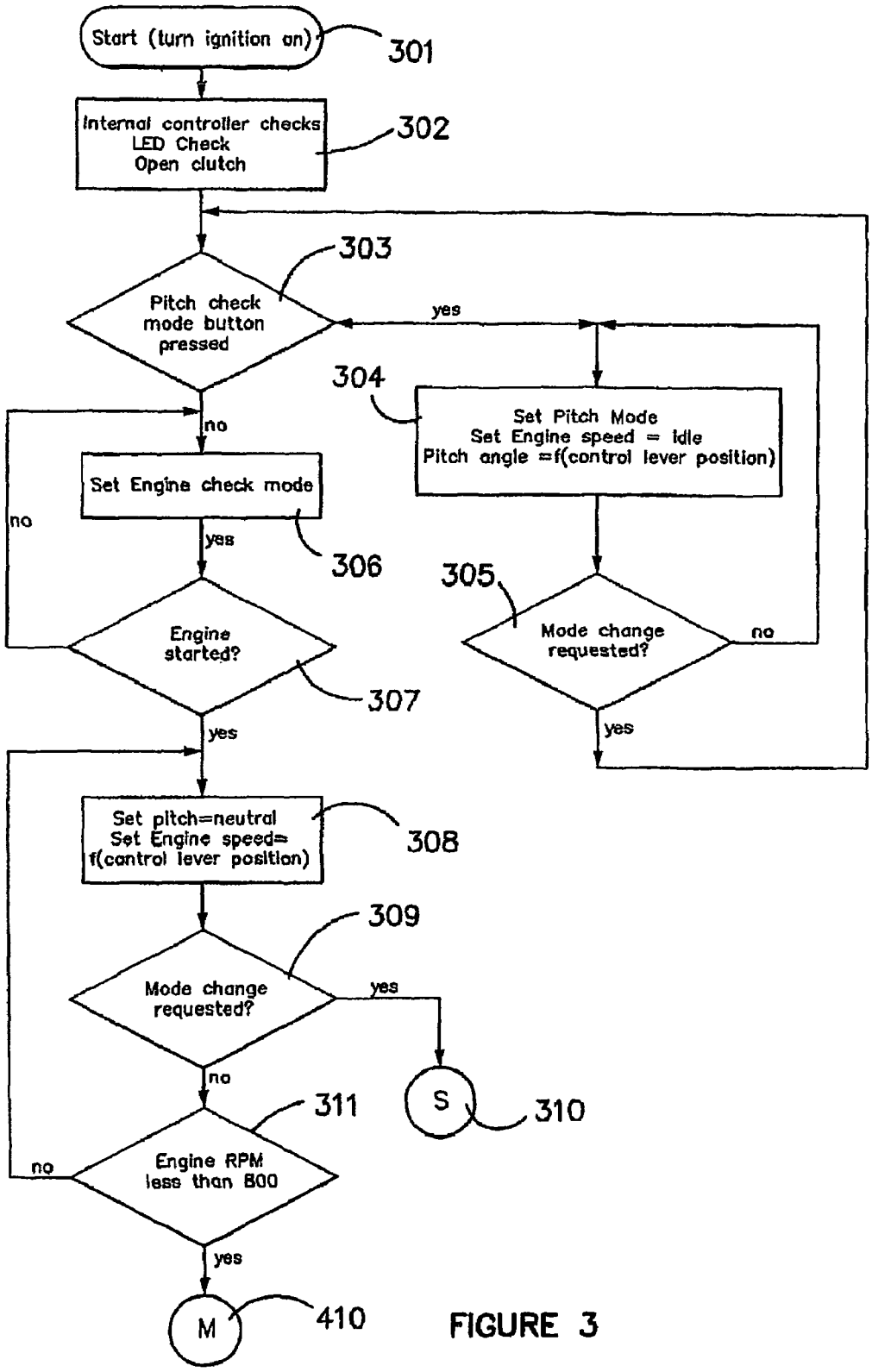
FIG. 3 is a flowchart showing startup operation of the control system and method according to the preferred embodiment.

FIG. 3 is a flowchart illustrating initial startup of the system according to the preferred embodiment of the invention. Upon initial startup, at step 301, by turning an ignition key in ignition switch 39, the electronic control systems including the pitch control unit 10 and the EDU motor controller 22 are powered. At step 302 light emitting diodes described with reference to FIG. 2 light up. The pitch control unit immediately sends a signal on line 13 to actuator 25 to open clutch 20 if the clutch is not already in an open condition. The system also goes through initial controller checks where various predetermined settings of the program are set and the pitch of the propeller blades 12 is adjusted by an output from the pitch control unit 10 via line 15 to motor controller 22 and on line 17 to DC motor 24 to move the propeller blades to a predetermined reference position so the system clearly knows where the pitch is set at initial startup of the system. This can be done by causing the propeller blades 12 to move between the fully reverse and fully forward position and then to a reference position under the control of the pitch control unit 10. The unit 10 is fed with information from the sensor 30 which can provide an indication of, for example, when the propeller blades are exactly at the reference position so that the control unit 10 can then control the DC motor to adjust the position to a predetermined position by suitable output on line 17 to the DC motor 24 to cause the output shaft 21 of the DC motor 24 to rotate to adjust the pitch of the blades 12.

At step 303, a determination is made as to whether pitch check mode button 27 has been pressed to place the system in a pitch check mode. This may be desired if the boat is on dry dock or the like so that the operation of the pitch control mechanism for changing the pitch of the propellers 12 can be checked. This can be done without starting the engine simply by turning the ignition key to an on position before the starter motor of the engine engages to start the engine. Thus, rather than start the boat, the ignition can simply be switched on and the pitch mechanism can be checked if a boat operator so desires. If the system has been toggled to the pitch mode by button 27, the program moves to step 304 where the engine speed of the engine is set to idle (even though the engine may not be operating) as a safety measure. Since the clutch is open, drive would not be transmitted from the engine 18 to the propeller 14 in any event, but setting the engine speed to idle ensures that if the engine is started for any reason, the engine will not rev above idle speed. At step 304, the pitch control unit 10 supplies a signal on line 15 to EDU motor controller 22 to in turn output a signal on line 17 to control DC motor 24 to change the pitch of the propeller blades 12. The pitch of the propeller blades is selected by the position of the control lever 28. The position of the control lever 28 results in a change in an output voltage from the control lever 28 to the pitch control unit 10 on line 19 and a look up table is used to select an appropriate value to which the pitch of the propeller blades should be adjusted dependent on the signal on line 19. Thus, by moving the control lever 28 between the full forward and full reverse positions, full range of movement of the propeller blades 12 from their maximum forward pitch to their maximum reverse pitch takes place so a visual inspection can be made to see that the mechanism is working properly. At step 305, the program monitors for a change in the mode setting, and if there is no change, the program cycles back to step 304 so that the pitch of the propeller blades can continually be adjusted by moving the lever 28. If there is a change, the program goes back to step 303 and a determination is made as to which of the mode buttons has been pressed.

If the ignition key at step 301 is initially turned fully on so that the engine is started, the same operation as described above will take place and pitch mode operation can be chosen if the pitch mode button 27 has been pressed. However, in startup of the engine, the program can delay the step 304 until the engine has fully fired up, so that the starter motor (not shown) which starts the engine 18 and the DC motor 24 are not drawing power at exactly the same time. If the engine is started, the system can monitor for a return to normal voltage of a battery (not shown) which supplies electrical power before the DC motor 24 is operated. This simply prevents too much drain on the battery or an attempt to draw too much current if the engine 18 is started concurrently with attempted operation of the DC motor 24. If the button 27 shown in FIG. 2 has not been pushed to toggle the system to manoeuvring mode, the program at step 303 moves to step 306 which will set an engine check mode sub-routine. At step 307, a check is made to determine whether the engine is started and if not, the program essentially circles back to step 306 waiting for the engine to be started. When the engine has started, the program moves to step 308 so that the engine check mode can be implemented. This step moves the pitch of the propeller blades to neutral position by output from the pitch control unit 10 on line 15 to the EDU 22 and then output from the EDU 22 on line 17 to the DC motor 24 to control the motor to place the propeller blades 12 in the neutral position.

The engine check sub routine will be described in more detail hereinafter, but basically this sub routine is in effect a default mode upon initial startup and allows the boat operator to rev the engine whilst the clutch 20 is disengaged and the propeller blades 12 are in a neutral position so as to either warm the engine or simply, by the sound of the engine, confirm that the engine is operating properly before the boat is driven away.

At step 309, a decision is made to determine whether the mode of operation has been changed by operating the switches 27 or 29 to place the boat back into either a pitch check mode, a manoeuvre mode or a cruise mode.

Figure 4:
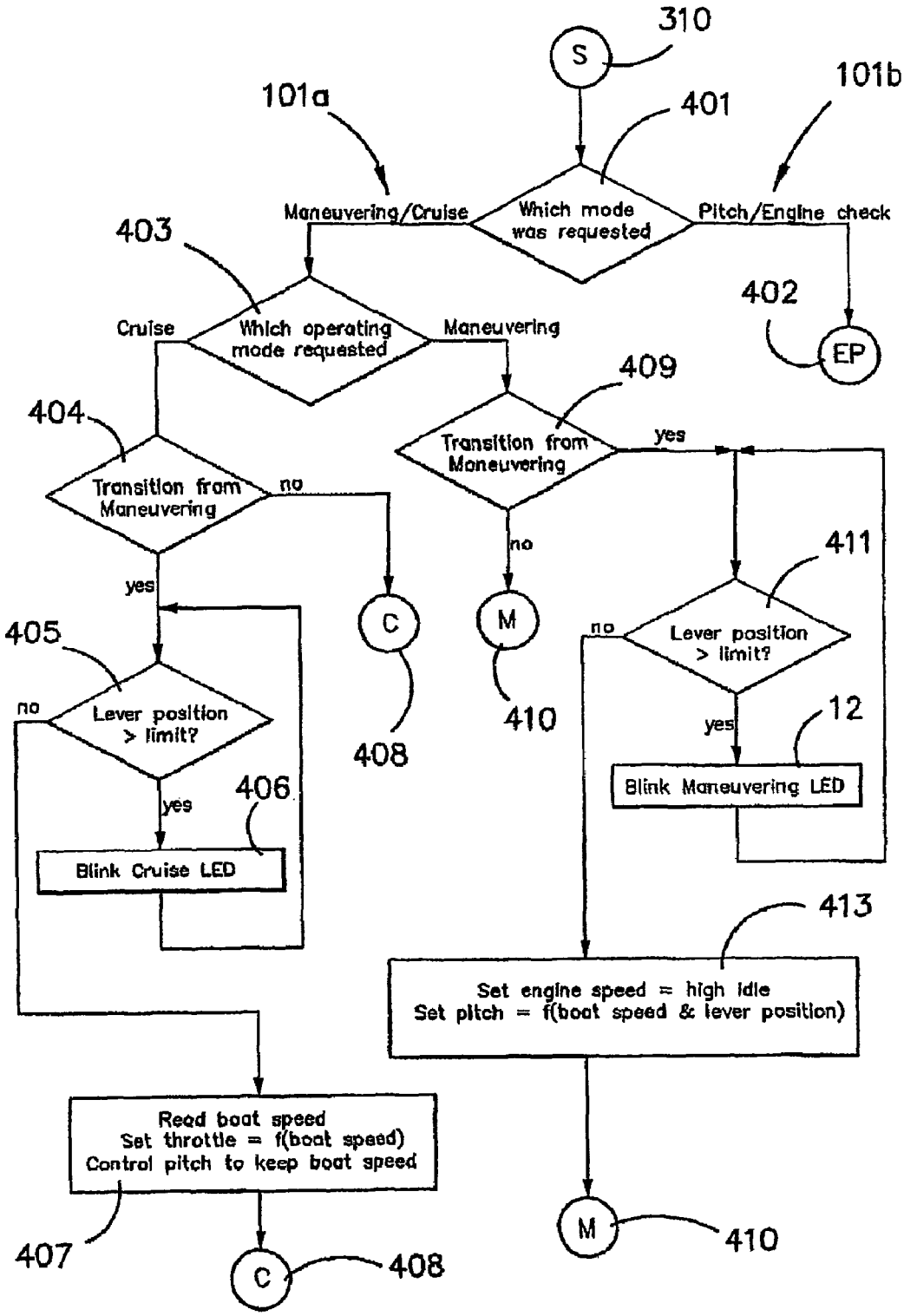
FIG. 4 is a flowchart showing system operating mode selection according to the preferred embodiment of the invention.

If there has been a change to the operating mode by toggling the switch 27 or switch 29, the program moves to position S at step 310 which is continued in FIG. 4. If there has been no change to the operating mode, the program moves to step 311 and the engine speed is monitored to determine whether the engine rpm is less than 800 rpm. The value of 800 is arbitrary and could be a different speed if required. The purpose is to ensure that the engine is operating at low speed before the. program moves past step 311. If the engine speed is less than 800 rpm, the program moves to step 410 to automatically place the watercraft in the manoeuvering mode. If the engine speed is greater than 800 rpm, the program moves back to step 308 waiting until the engine speed drops to a level below 800 rpm so that the system can automatically go to manoeuvering mode at step 410 or awaits a change of mode by toggling one of the switches 27 or 29 so that the program moves to step 310.

FIG. 4 is a flowchart showing how the system operates when one of the switches 27 or 29 is toggled to select a particular operating mode which is identified by step 401 in the flowcharts.

With reference to FIG. 4, at step 401, a decision is made to determine which of the modes has been requested by pressing the button 27 or 29. The two possible modes are the manoeuvring/cruise mode by pressing button 29 or the pitch/engine check mode chosen by pressing switch 27. The switches 27 and 29 are momentary contact switches which effectively toggle either the pitch check mode or the engine check mode in the case of the switch or button 27, or the manoeuvring mode or cruise mode in the case of the switch or button 29. The particular mode of the switch can easily be seen by the illumination of the light emitting diodes 45, 47, 49 and 51.

Figure 5:
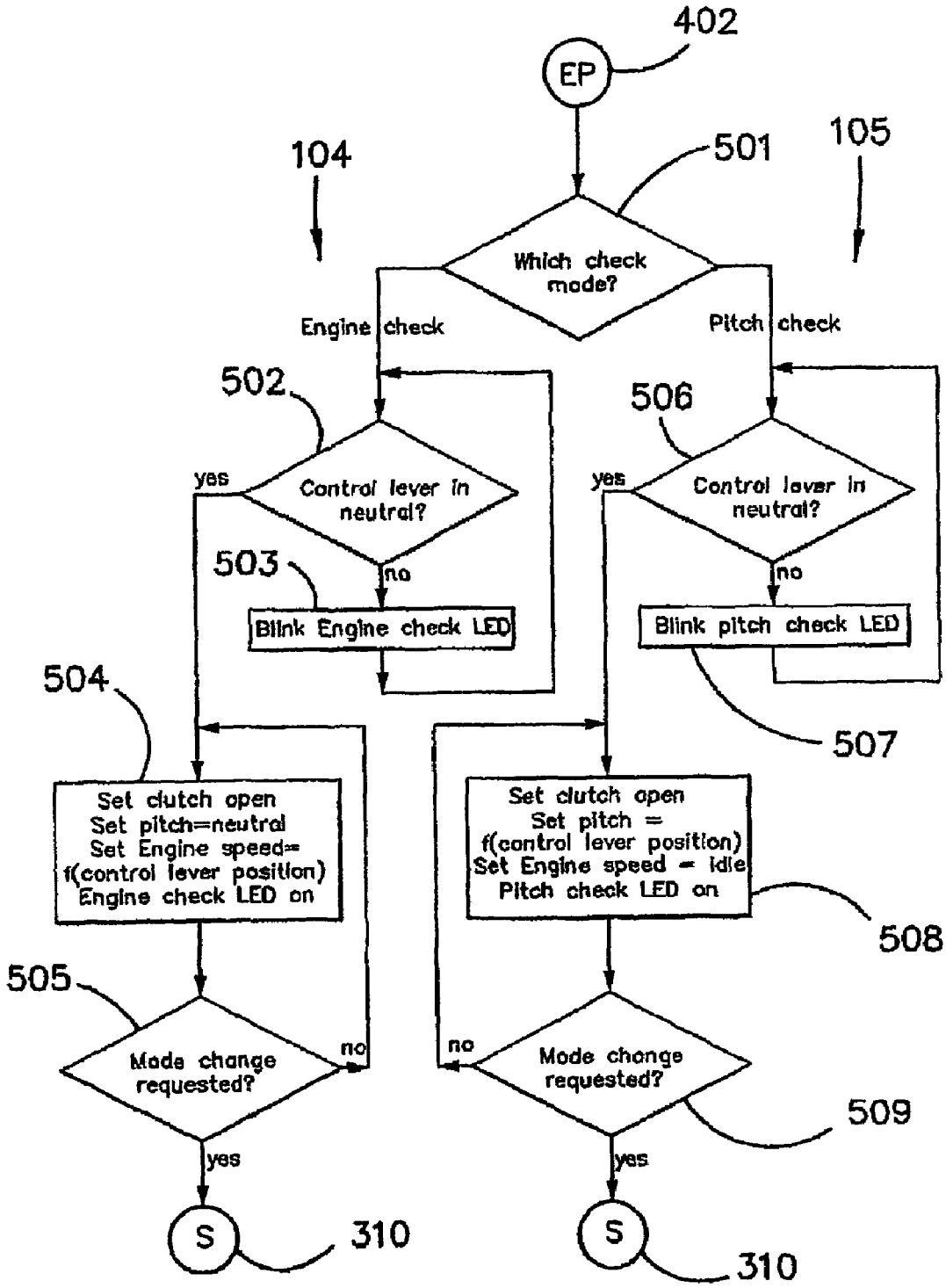
FIG. 5 is a flowchart showing an engine check and a pitch check routine according to the preferred embodiment of the invention.

Assuming that the button 27 is operated, the program moves to step 402 which is continued in FIG. 5.

With reference to FIG. 5, a decision is made at step 501 to determine whether the switch 27 has been pushed to change between the engine check mode or the pitch check mode. If in the engine check mode, the program moves to step 502 where a decision is made as to whether the control lever 28 is in the neutral position. If the control lever 28 is not in the neutral position, light emitting diode 47 is flashed at step 503 to alert the boat operator that the lever must be moved to the neutral position. When the lever is in the neutral position, step 502 is answered in the affirmative and the program moves to step 504 where the clutch 20 is opened by a signal output on line 13 to actuator 25 to open the clutch if the clutch is not already in the open position. The pitch control unit 10 outputs a signal on line 15 to the EDU 22 which in turn outputs a signal on line 17 to the DC motor 24 to place the propeller blades in the neutral position, as per step 308, and the engine speed is set by movement of the control lever between the neutral and full forward positions and the engine check light emitting diode 47 is illuminated to show that the system is in the engine check mode. Thus, the boat operator can simply rev the engine by back and forward movement of the lever 28. The output on line 11 is selected from a look up table which picks the output dependent on the position of the lever 28 and the signal supplied on line 19. Thus, when the lever is moved back and forward, the engine throttle assembly (not shown) is operated to cause the engine to rev. At step 505, a decision is made as to whether there has been a mode change request by pressing one of the buttons 27 or 29. If no, the system remains in the engine check mode. If there has been a change to the requested mode, the program moves to step 310 which takes the program back to FIG. 4, as previously explained.

If the mode check at step 501 determines that the button 27 has been placed in the pitch mode check position, the program moves to step 506 to again determine whether the control lever is in the neutral position. If the control lever 28 is not in the neutral position, light emitting diode 45 flashes at step 507 to indicate to the boat operator that the lever should be moved to the neutral position. When the lever has been moved to the neutral position, the program moves to step 508 where the clutch 20 is opened by a signal to the actuator 25 in the same manner as previously described. The engine speed is set to idle by a signal on line 11 so that the engine simply operates at idle speed. The control lever position 28 in this mode does not rev the engine, and the engine remains at idle speed as set. Rather, movement of the lever 28 moves the propeller blades 12 so the pitch of the propeller blades is adjusted whilst the engine is at idle speed. Once again, the position of the lever 28 changes the voltage signal on line 19 so that that signal can be used to select an appropriate value from a look up table to supply on line 15 to controller 22 to in turn control the DC motor 24 to change the pitch of the propeller blades 12.

At step 509, a determination is made as to whether there has been a mode change request by pressing one of the buttons 27 or 29, and if no, the program returns to step 508 to remain in the pitch check mode. If there has been a change, the program moves to step 310, which again takes the program back to FIG. 4 as previously mentioned.

Returning to FIG. 4, if the button 29 was depressed rather than the button 27, the program moves from step 401 to step 403 and a determination is made as to whether the depression of the button 29 will place the system into the manoeuvring mode or the cruise mode. If the switch 29 was placed in the cruise mode, the program moves to step 404 and a determination is made as to whether the system is transitioning from manoeuvring mode into the cruise mode. If no, the system moves to step 408 which is continued in FIG. 6, and will be described hereinafter.

If step 404 decided that the system was transitioning from manoeuvring mode to cruise mode, the system goes through a routine to effect a smooth transition between those modes in the event that in the manoeuvring mode, the throttle 28 was in a position which, if the system immediately moved to cruise mode, would result in an unwanted change in characteristic of the boat, such as a rapid acceleration, rapid deceleration or the like.

If step 404 is answered in the affirmative, the program moves to step 405 and the position of the lever 28 is determined having regard to the present operating conditions of the boat, and if in an extreme position which would cause a rapid alteration to the manner in which the boat is travelling, light emitting diode 51 is flashed at step 406 requiring movement of the lever 28 before the boat will respond to the position of the lever 28. If the answer to the question at step 405 is yes the light emitting diode 51 is flashed at step 406 indicating that the operator needs to move the control lever 28 before the boat will respond in cruise mode. Thus, the boat remains in manoeuvring mode with the engine speed and pitch of the propeller being the same as that at which it was in manoeuvring mode. The light emitting diode 51 will continue to flash until the operator moves the control lever 28 back to a position towards neutral at which it will match the boat speed by appropriate control of the engine and pitch of the propeller as if it were in cruise mode. Thus, the operator should continue to move the lever back until the light emitting diode 51 stops flashing, thereby indicating that the lever is now in the correct position, or within a predetermined limit of that position. If the lever position is moved so it is within the predetermined limit the program moves from step 405 to step 407 where the boat speed is read from the system 35 and the engine 18 is controlled by output on line 11 from the pitch control unit 10 to provide an appropriate engine speed or torque for that boat speed and the pitch of the propeller blades 12 is controlled by outputs on line 15 to controller 22 and line 17 to DC motor 24 to maintain that boat speed. Then as the operator continues to move the control lever 28 the boat can be driven in cruise mode. Thus; this prevents the boat from operating in an unsatisfactory way on transition from manoeuvring mode to cruise mode if, for example, the pitch of the lever 28 is in such a position when last manoeuvring that the lever was close to wide open throttle position and the pitch in a full forward position that if the mode immediately changed to cruise mode this would be interpreted as a requirement for maximum engine power causing the boat to accelerate as quickly as possible. Thus, the system ensures that the operator needs to move the control lever 28 to effectivity pick up the operating conditions of the boat, so the throttle position effectively matches those operating conditions, before the boat will respond in cruise mode.

If at step 403 a determination is made that the switch 29 has toggled the system to the manoeuvring mode, the program moves to step 409 from step 403. Again, a check is made as to whether this mode results in a transition from a cruise mode to a manoeuvring mode, and if no, the program moves to step 410 which is continued in FIG. 7 and will be described in detail hereinafter. If at step 409 a decision is made that the mode is being switched from cruise mode to manoeuvring mode, the program moves to step 411. Once again, a decision is made similar to that in step 405 to determine whether the lever position 28 is in a position which, if the mode is immediately changed, would cause unsatisfactory response from the boat. If the lever position is outside predetermined limits, having regard to boat operation, such as boat speed or the like, light emitting diode 49 is flashed at step 412 to indicate this to the boat operator and the boat operator needs to move the lever 28 to a position such that upon change to manoeuvring mode, the boat will not respond in an unsatisfactory manner. Thus, the operator must move the lever 28 to a position which matches the present boat operating condition before the system will respond in the manoeuvring mode. Thus, if the engine speed or pitch propeller position is such that the transition would cause the boat to slow rapidly on change from cruise mode to manoeuvring mode this is prevented and will not happen. If the lever position 28 is not greater than a preset limit or has been moved by the operator, the program can move to step 413 where the boat is placed ready for manoeuvring mode at step 413 by setting the engine speed 18 to a high idle speed such as a speed of about 1500 rpm by an appropriate signal on line 11. The pitch of the propeller is set based on a speed reading from the GPS system 35 so that the pitch is set to a position which matches both the boat speed and lever position so that a sudden change in boat speed does not occur on switch over from manoeuvring mode to cruise speed. Typically, this change in speed when moving from cruising mode to manoeuvring mode would be a rapid slow down of the boat. Thus, by setting the pitch and monitoring lever position so the manoeuvring mode is not implemented until the lever is in a position which will match the operating conditions of the boat when in manoeuvring mode, a sudden speed change does not occur and the boat continues operating until the driver operates the boat in the new mode by operation of the lever 28. The movement of the lever 28 will then cause the pitch control unit 10 to respond to movement in lever position 28 by outputting signals on line 15 so the pitch of the propeller blades 12 are adjusted in response to movement of the lever 28 whilst the engine speed 18 is not changed.

Figure 6:
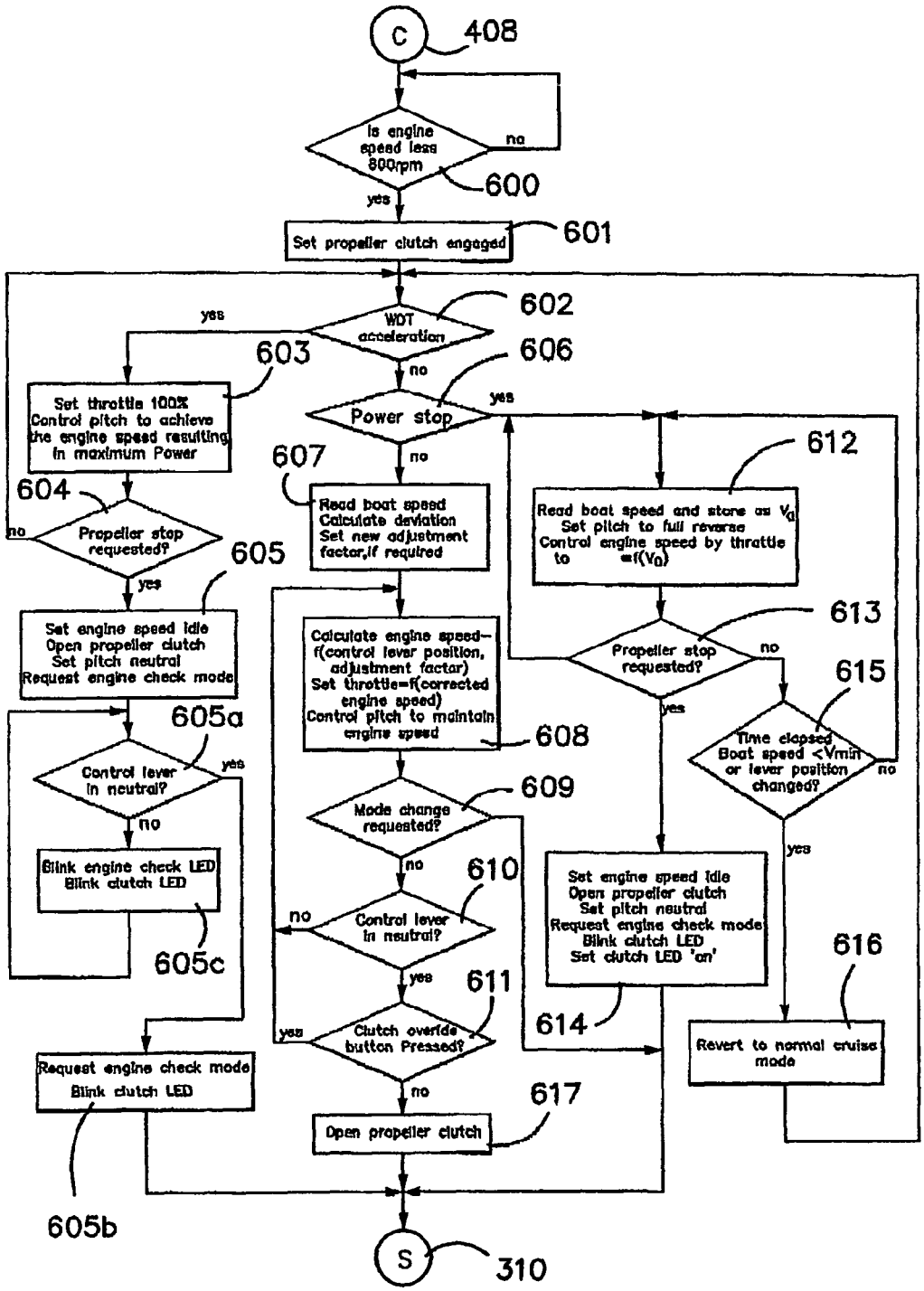
FIG. 6 is a flowchart showing a cruise mode routine according to the preferred embodiment of the invention.

Turning now to FIG. 6, when the system moves to step 405 for cruise mode, either directly via step 404 or from step 404 through the transition steps 405 to 407, a check is initially made at step 600 to determine whether the engine speed is less than 800 rpm. If no, the program cycles at this step awaiting the engine speed to drop to 800 rpm or less. This prevents the cruise mode from commencing with an, engine speed which is initially very high, which may cause unexpected and unwanted rapid acceleration. When: the engine speed has dropped to less than 800 rpm, the program moves to step 601. At step 601, the clutch 20 is engaged. At step 602, a decision is made as to whether wide open throttle acceleration is required. This decision is made based on the position of the lever 28 and therefore the voltage signal on line 19. If the lever 28 is moved fully forward indicating full throttle power is required, step 602 is answered in the affirmative. If the lever 28 is moved quickly indicating the boat operator requires rapid acceleration the system is placed in wide open throttle condition until the boat speed matches that required by the new position of the lever 28. The speed of movement of the lever 28 is determined by simply measuring the time it has taken to move the lever 28 from its initial position to its new position (ie. dx\dt). If this occurs, the program moves to step 603 and the pitch control unit 10 immediately outputs a signal on line 11 for full throttle open position to the engine so that the engine delivers maximum torque. The pitch of the propeller blades 12 is set by the EDU 22 and DC motor 24 to achieve the engine speed resulting in maximum power. At step 604, a determination has been made as to whether a propeller stop has been requested by pressing button 43. Button 43 can be pressed in an emergency situation if it is desired to immediately stop rotation of the propeller 14 in the event of an emergency situation, such as the boat becoming beached, approaching a diver or other hazard or dangerous situation. If step 604 is negative, the program returns to step 602 and simply continues. If propeller stop is required, the program moves to step 605 where the output on line 11 from the pitch control unit 10 to set the engine rpm speed to idle and open the clutch 20 by signals on lines 11 and 13 respectively. Concurrently the unit 10 outputs a signal on line 15 for the EDU 22 to control the DC motor 24 to place the propeller blades 12 in a neutral position. At step 605, the system automatically defaults to the engine check mode. This simply results in the system having to be manually set to another mode before the propeller will again operate, so the propeller cannot be caused to operate erroneously while the boat is still in a hazardous situation. After step 605, the program moves to step 605*a* where a determination is made as to whether the control lever has been moved to the neutral position. If the answer is yes, the program moves to step 605*b* indicating that the engine check mode has been requested and the clutch light 55 is blinked indicating that the clutch is disengaged to show the driver that no drive is being supplied to the propeller 14. If at step 605*a* the control lever is not in neutral, the program moves to step 605*c* in which the engine check LED 47 is blinked and the clutch light 55 is also blinked. The clutch light indicates that the clutch is open and the engine check LED 47 indicates to the driver that the control lever 28 needs to be moved before anything further will happen. Step 605*c* returns to step 605*a* waiting for an indication that the control lever has in fact been moved to the neutral position before the program will then move to step 605*b*. After 605*b*, the program moves to step 310 waiting for a particular mode selection.

If propeller stop is not requested at step 604, the program returns to step 602 where a decision is again made as to whether wide open throttle conditions are still present. If wide open throttle conditions are not required, the program moves to step 606 and a determination is made as to whether power stop is required. Power stop occurs when the boat operator moves the control lever 28 quickly into the full reverse position, thereby indicating that the pitch of the propeller blades 12 are to be changed to provide braking so that the boat slows down as quickly as possible. Again, this determination can be made by simply monitoring the voltage on line 17 and the speed at which the lever 28 (dx\dt) is moved into the fully reverse position. If power stop is not required, the program moves to step 607 where a determination of the boat speed is made from the GPS speed system 35. At step 607, an appropriate one of several operating curves for engine speed pitch position, depending on the load on the boat including the number of people in the boat, sea conditions and the like can be determined so that particular adjustment factors can be selected based on the operating curve which is deemed most desirable having regard to load conditions and the like.

Figure 6A:
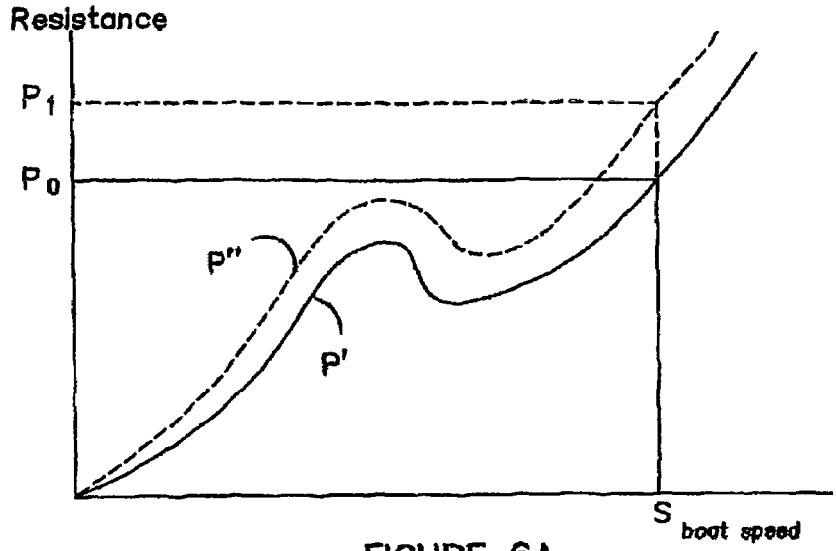
FIG. 6*a* and FIG. 6*b* are diagrams illustrating operation of part of the process according to the flowchart of FIG. 6.
Figure 6B:
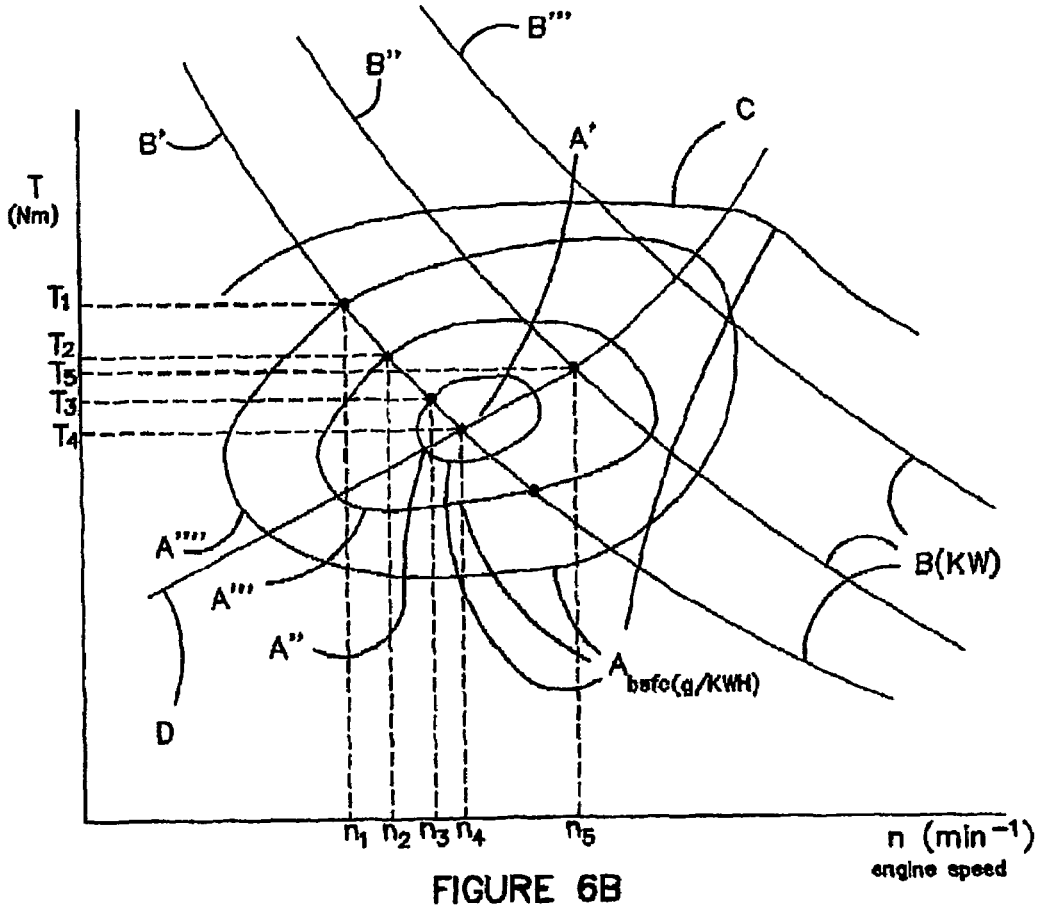

FIGS. 6A and 6B are graphs illustrating how an appropriate operating curve is selected at step 607. FIG. 6A is a graph showing resistance versus boat speed for a particular power curve P'. If for example the control lever 28 is moved to a position where boat speed S would be called for, the normally appropriate power is Po on the power curve P'. This power curve may be applicable if for example the boat is lightly loaded with for example two people. If the boat is more heavily loaded the particular power Po will not be sufficient to achieve the boat speed S and another curve such as the power curve P" needs to be considered indicative of the fact that the boat is more heavily loaded with people. Thus, the particular power required to reach boat speed S may be P1. The program is able to learn which appropriate power curve is required to produce a boat speed S having regard to the loading or resistance for both experiences during operation and if for example the boat does not reach speed S with power Po the program determines that it needs to move to another power curve applicable for greater resistance or loading on the boat in order to reach that speed.

After the appropriate power curve is selected FIG. 6B shows how a particular engine torque and engine speed will be selected in order to provide the most economic operating conditions to produce the required power to in turn produce the required boat speed S.

FIG. 6B shows a graph of torque in newton metres against engine speed in revolutions per minute. The curves A are brake specific fuel consumption curves which give equal fuel consumption in grams per kWh. Curves B are curves of equal power in kW. Curve C is the wide open throttle torque curve.

Thus, for the curves A each point on each of the respective curves gives an equal amount of fuel per kwh. The lowest fuel consumption is the curve A' (which is effectively a point) and then fuel consumption increases outwardly at curve A", A'" and with the curve A"" being the highest consumption. Thus, for a desired engine power such as that given by curve B' a number of different torques and engine speeds are possible such as those shown by T1N1, T2N2, T3N3, and T4N4. To achieve the best fuel economy for, for example, power B', the intersection of line D of best fuel consumption and curve B' should be selected. This will therefore provide the engine speed which is required to give maximum fuel economy and the pitch of the propeller 14 is adjusted from a look-up table in order to maintain the engine speed N4. If for example the throttle is moved thereby indicating more power is required such as that given by curve B" then it will not be possible to produce the minimum fuel economy at point A' because the curve B4 obviously does not go through that point. Thus, the most appropriate engine speed and torque will be that closest to point A' such as that given by torque T5 and engine speed N5. Once again the look-up table will provide the appropriate pitch setting in order to maintain the engine speed at N5 thereby delivering the best fuel economy for the required power to produce the required boat speed. Alternatively, a suitable pitch of the propeller blades 12 of the propeller 16 can be selected from an appropriate look up table for the specific power requirement, and the throttle of the engine is used to control the engine speed to the speed required for best economy, in this case n5.

Thus, step 607 enables an appropriate power curve to be selected to match required boat speed having regard to resistance or load on the boat. The power curve can be related by a particular deviation factor which is used to change from one power curve to another depending on the perceived load or resistance of the boat. This then enables only one power curve to be provided and for that power curve to be adjusted by a load factor to be used to select the power in FIG. 6B on one of the curves the B', B" and B"', etc., or by interpolation between them.

At step 608 engine speed 18 is set by selecting the appropriate value as described above having regard to the position of the lever 28 and therefore the voltage on line 19, and pitch position is selected from a look up table in pitch control unit 10, to maintain that engine speed and therefore deliver the required engine power to provide the required boat speed. As noted above in step 607, the particular value may be adjusted depending on the particular operating curve which is selected at step 607. Thus, the movement of the control lever results in a change in voltage on line 19 and therefore selection of appropriate values from the look up table for output on line 11 to set engine speed 18 dependent on the position of the lever 28. The pitch of the propeller 12 is also adjusted to maintain engine speed by outputs on line 15 to EDU 22 and output on line 17 to DC motor 24 to adjust the position of the blades 12 to maintain the engine speed as low as possible whilst maintaining the boat speed as required by the boat operator. Thus, in other words, by movement of the lever 28, the boat operator is effectively setting boat speed and the engine speed and pitch of the propeller responds to provide that speed, whilst at the same time providing maximum economy by selecting the appropriate operating curve at step 607.

At step 609, a decision is made as to whether there has been a mode change by operation of one of the switches 27 or 29. If no, the program moves to step 610 where a decision is made as to whether the control lever 28 has been moved to the neutral position. If the answer is no, the program moves back to step 608 where the engine speed parameters, as referred to in step 608 are maintained dependent on the position of the lever 28. If the control lever 28 has been moved to the neutral position, the system looks to determine whether there has been a clutch override command at step 611 by pressing button 32 in FIG. 2. This enables the clutch to be placed in a closed condition whilst holding the button 32 depressed for example, so that the lever can be moved in and out of neutral position to slightly move the boat forward or backwards in the cruise mode by the program returning to step 608. This simply stops the boat from being placed in a neutral position and for the clutch 20 to be disengaged, thereby completely shutting off drive to the propeller 14 and requiring reengagement before the boat can again be moved under power.

If there was no depression of the clutch button 32 at step 611, the program moves to step 617 to open the clutch 20 and then to step 310 waiting for mode selection after the lever 28 has been placed in the neutral position.

If mode selection is changed at step 609, the program also moves to step 310 awaiting for selection of the new mode.

If power stop conditions at 606 are determined, the program moves to step 612 where the pitch of the propeller blades 12 are set to the full reverse position to provide braking effect by output of a signal on line 15 to EDU 22 and by output of a signal from EDU 22 to motor controller 24 to thereby adjust the position to the full reverse position. At the same time, the output on line 11 is set to control the engine speed 18 to achieve appropriate power dependent on boat speed as provided by GPS speed system 35, when power stop is requested. Thus, if power stop is requested and the boat is travelling at very high speed, then the amount of engine power which is required will be high and the engine speed may be controlled so as to give a speed of, for example, 4000 rpm to provide the required power to reduce boat speed when the propeller 14 is in full reverse pitch. However, if the boat is travelling at, for example, only 15 knots, then the amount of engine power required is considerably less and the engine may be controlled to a speed of, for example, 2000 rpm to reduce the speed of the boat with the propeller 14 in full reverse pitch. Thus, the engine power selected will be a function of the actual over-the-ground boat speed which is provided by the GPS system 35.

Furthermore, the engine speed is also controlled to ensure that, as the lever moves from the forward position back through neutral to the reverse position, the engine does not unnecessarily over-rev as the pitch of the propeller 14 goes through the neutral position. If the engine is developing a considerable amount of power, even though the revs may be relatively low, and the boat is at low speed, the engine may unnecessarily rev as the propeller 14 moves to the neutral pitch position which may not only unnecessarily over-rev the engine, but may also cause an unwanted response from the boat. Thus, the engine speed is controlled as a function of the boat speed so the engine does not over-rev and the required amount of power is delivered by the engine, having regard to boat speed, so the engine does deliver sufficient power to rapidly slow the boat in the power stop mode when the pitch of the propeller 14 is set to the full reverse position. At step 613, a decision is made as to whether the emergency propeller stop button 43 has been pressed, indicating that not only is power stop required, but the boat operator wishes to immediately shut off the propeller 14. If yes, the program moves to step 614 at which the same steps described with reference to steps 605*a*, 605*b* and 605*c* are performed to stop rotation of the propeller 14. If propeller stop is not requested, the program moves to step 615 where an indication is made as to whether the boat speed as supplied from the GPS speed system 35 is less than a predetermined minimum or whether the control lever 28 has been moved. If the predetermined minimum speed has been reached, this indicates that the boat has slowed as required by the boat operator, and the program returns to step 602 via step 616 which reverts to normal cruise mode for control by lever 28 to again drive the boat forward or backwards under boat operator control, which will occur by the program moving through step 602 and then 603 to 605, or step 606 to 611. If the boat speed has not dropped to the minimum value, and the lever 28 is moved from the full rear or reverse position, this indicates that the boat operator may again wish to speed up the boat in the forward direction before reaching minimum speed. Thus, the program again moves to step 616 to revert to normal cruise mode, and then to step 602.

Thus, during power stop, if the boat has not reached the predetermined minimum speed, and for some reason the boat operator decides it would be preferable to again speed up the boat, this can be done simply by moving the lever without first waiting for the boat to reach the predetermined minimum speed, and once the lever is moved, the boat can be moved in cruise mode as previously described. If the answer at step 616 is no, the program simply moves to step 612 and the power stop conditions continue.

In an alternative embodiment, rather than rely on the boat speed reaching a minimum speed before reverting to cruise mode, the amount of time the system has been in power stop mode is measured so that after, for example, a predetermined time limit of 3 seconds, the program will move from step 615 to step 616 to revert to normal cruise mode. Thus, rather than monitoring boat speed or lever position in order to revert back to cruise mode, the time elapsed and lever position is monitored so that if the predetermined time period expires, or the operator changes the lever position, the system moves to step 616 to revert the system back to normal cruise mode.

During power stop mode, continuous engine power may be made available at all times as soon as the lever is quickly pulled back to instigate power stop mode. However, in a more preferred embodiment, as soon as power stop mode is recognised, which is caused by the rapid movement of the lever as previously explained. Power can be shut off until such time as the pitch of the propeller blades is adjusted to a negative or reverse position, and then power is applied. Thus, the engine revs could drop to idle and then increase as soon as the blades are in the reverse or negative pitch position. This therefore provides slightly quicker stopping because power is immediately disrupted while the pitch propeller blades transition from a position giving forward movement to a reverse or negative position, and power is only again applied when the negative or reverse position of the blades is reached.

Figure 7:
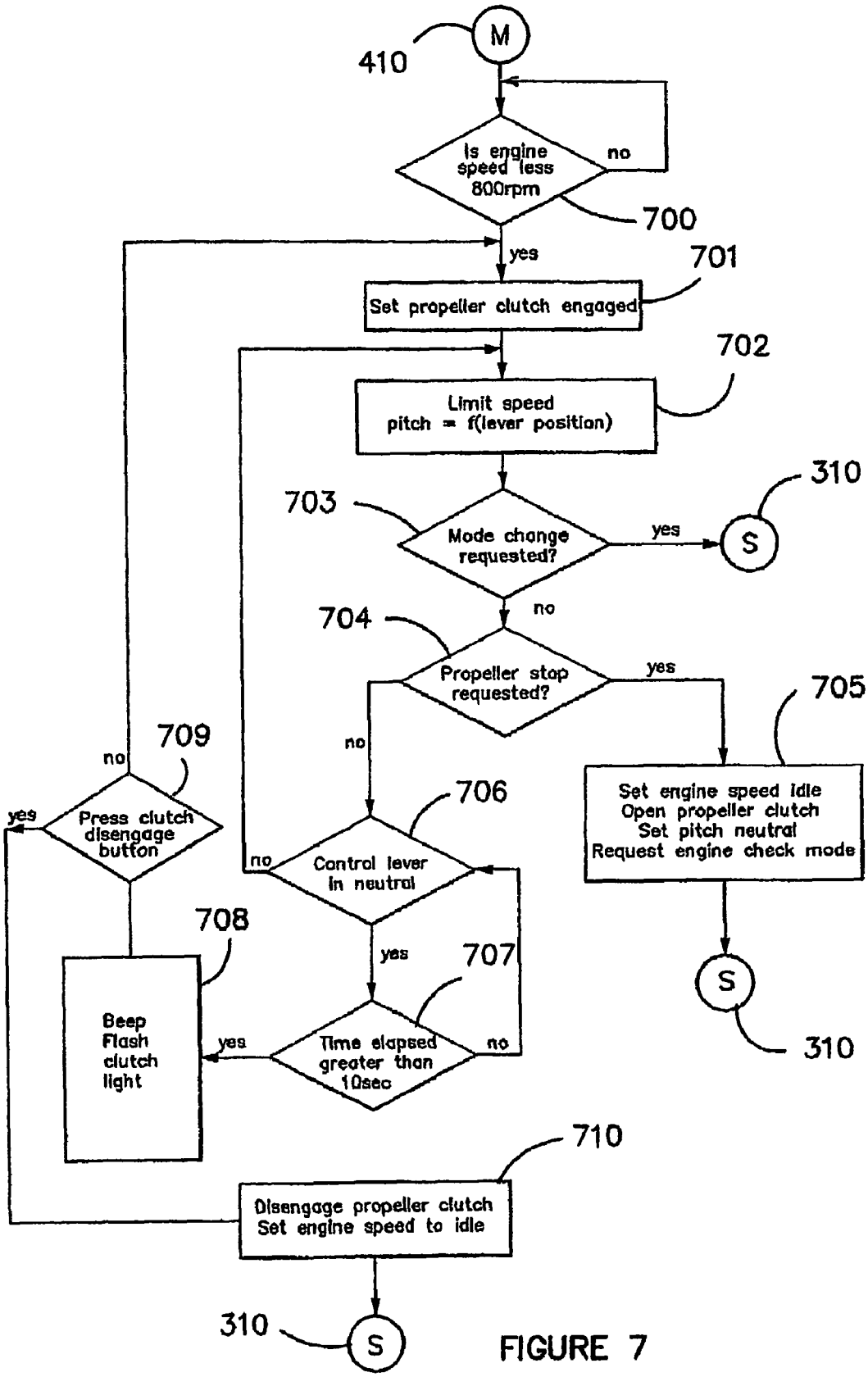
FIG. 7 is a flowchart showing a manoeuvring mode routine according to the preferred embodiment of the invention.

If in FIG. 4 the system moves to step 410 indicating manoeuvring mode is required, the boat moves into manoeuvring mode condition as shown in FIG. 7. FIG. 7 also shows how the manoeuvering mode is implemented when the system moves from step 311 in FIG. 3 to FIG. 410 after initial start up and when the engine speed drops to less than 800 rpm.

With reference to FIG. 7, at step 700 a decision is made as to whether the engine speed is less than 800 revolutions per minute. If no, the program continues to cycle back making this check until the engine speed drops to this speed to prevent manoeuvering mode from occurring with an engine speed initially at a high rpm value. If the engine speed has dropped to less than 800 revolutions per minute, the program then moves to step 701. At step 701 the clutch 20 is engaged if not already engaged, and at step 702 the engine speed is set to high idle speed by a signal on line 11 to, for example, 1500 rpm. This enables the engine to deliver relatively low power to the propeller 14. At step 703, a check is made as to whether the mode has been changed by pressing the button 27 or the button 29 and, if so, the program moves to step 310 back to FIG. 4 for control under the particular mode as selected. If there has been no change in mode, the program moves to step 704 and a determination is made as to whether propeller stop button 43 has been pressed and, if so, the program moves to step 705 which again implements the same steps as described with reference to steps 605 and 614, and thereafter moves to step 310 waiting for mode selection. If propeller stop is not selected, the program moves from step 704 to 706 to determine whether the control lever is in the neutral position. If no, the program moves back to step 702 and if yes, the program moves to step 707. At step 707, a determination is made as to whether the control lever has been in the neutral position for more than 10 seconds. If the control level has not been in the neutral position for more than 10 seconds indicative of the fact that the control lever is being moved to manoeuvre the watercraft, the program moves back to 706 and this cycle continues until such time as the lever is left in the neutral position for more than 10 seconds. The fact that the lever has been left in the neutral position for more than 10 seconds may be indicative of two possibilities. The first possibility is that the boat is effectively being parked, or secondly, the boat is needed in the manoeuvering mode but has been left standing until an obstacle clears or the boat has a clear path for continued manoeuvering. If the decision at step 707 is answered in the affirmative, the program moves to step 708 where the clutch light 55 is flashed and an audible sound such as a beep can be generated to alert the operator to the fact that the boat is still in the neutral condition. This simply alerts the operator in case the operator has erroneously left the boat in the manoeuvering mode with the lever in neutral but the propeller still connected by the clutch to the motor. If the fact that the lever has been left in neutral is intentional, then the beeping sound or flashing clutch light 55 simply continues until the driver provides the next operational command. At step 709, a decision is made as to whether the clutch disengage button 32 has been pressed to disengage the clutch 20. If the answer is yes, the program moves to step 710 and the clutch is disengaged and the engine speed is set to idle. The program then moves to step 310 awaiting an input to select a particular operating mode or the system can simply be shut off. If the clutch button 32 is not pressed, the program moves back to step 702 and continues as above.

Thus, the operator is alerted to the fact that the control system has been left in the neutral mode with the propeller engaged so that if this was erroneously done, the clutch 20 can be opened if necessary. If the delay is simply due to the operator needing to wait for a clear path before continuing manoeuvering, the clutch is not automatically disengaged, which means the operator does not have to continually reengage the clutch whilst in the manoeuvering mode, and manoeuvering mode will continue as soon as the control lever is moved away from the neutral position in accordance with steps 702 to 707.

If, at step 706, the answer is that the control lever is not in neutral, the program moves back to step 702.

At step 702, the available engine speed is limited when in cruise mode so as to be less than the maximum available engine speed which could be used when in cruise mode. The limiting of the engine speed ensures that full engine speed is not available in cruise mode when fine operations are required and manoeuvring occurs primarily under the influence of pitch adjustment of the propeller with some possible change in engine speed.

The limiting of the engine speed can be achieved in two ways. In a first embodiment, the engine speed is fixed at a predetermined speed such as a high idle speed of about 1500 rpm. Assuming that the system uses a transmission ratio of 2:1, this will result in a propeller shaft speed and propeller rotation speed of 750 rpm. In a second embodiment, some adjustment of the speed of the engine is available in manoeuvring mode, but the amount of engine speed is limited to be less than the maximum engine speed, and typically to an engine speed of about 30% of maximum engine speed, which will provide about 30% of normal full open throttle power.

Thus, at step 702, the pitch of the propeller blades 12 are adjusted by moving the control lever 28 whilst the engine speed is limited as mentioned above. Thus, in the manoeuvring mode, the control lever 28 changes boat speed by causing the control unit 10 to change the pitch of the propeller blades 12 whilst the engine speed is maintained constant or varied only a relatively small amount by the control unit 10, whereas in the cruise mode, the movement of the lever 28 changes boat speed by causing the control unit 10 to set a combination of engine power (which may be provided by maximum engine speed) and pitch of the propeller blades 12. Thus, a single control lever 28 is used in the cruise mode to change engine power and propeller pitch and therefore boat speed, whilst in manoeuvring mode the control lever 28 changes the pitch of the propeller blades 12 whilst the engine speed is limited.

Movement of the control lever 28 in manoeuvring mode if it is desired to enable engine speed to be changed results in only a maximum of up to 30% full open throttle to be achieved through the full operating range of the lever. Furthermore, in the manoeuvring mode, the amount of pitch adjustment is also slightly less than that which is available when in cruise mode. Thus, once again, full throttle movement may only change pitch for, for example, up to 70% of the amount of pitch change which is available when in cruise mode.

Figure 8:
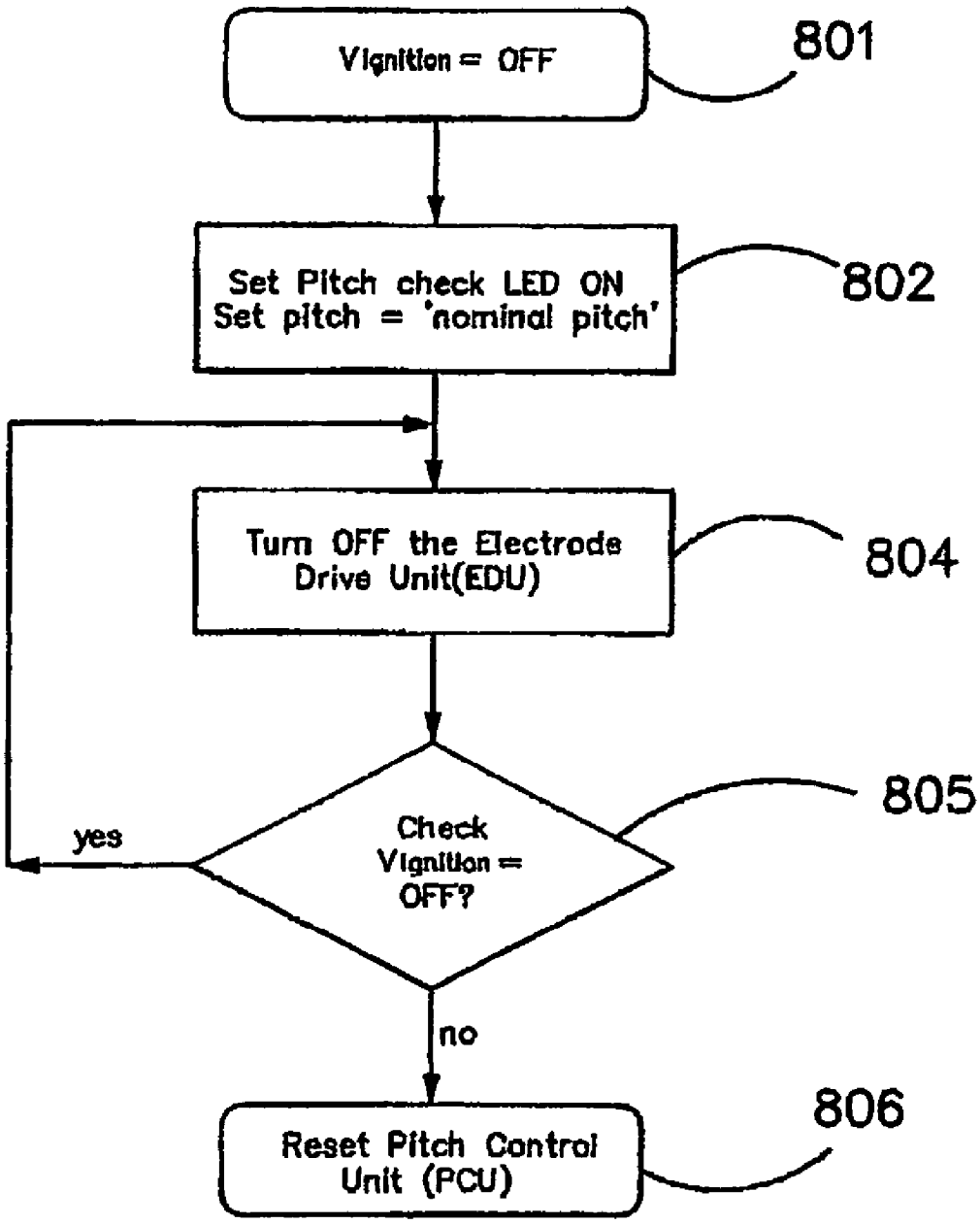
FIG. 8 is a view showing engine shutdown.

FIG. 8 is a flow diagram showing engine close down when it is desired to shut off the engine. At step 801 a determination is made as to whether the ignition 39 is switched off. At step 802 the light emitting diode 45 indicating pitch check mode is switched on, and the pitch of the propeller blades 12 is adjusted to a default pitch position. This will make it easier to locate the pitch of the propeller blades at the reference pitch position next time the engine is started, assuming that there has been no movement of the pitch of the propeller for whatever reason during the time the boat was switched off. Movement of the pitch may occur if maintenance is performed or the like. However, in most instances there will be no change in the position of the propeller blades after engine close down and therefore the pitch of the propeller blades is set close to the reference pitch position to make initial calibration and location of the pitch upon engine start up much easier and to provide a positive pitch if adjustment is not possible. Thus, if the boat is stopped and for whatever reason the pitch is not able to be changed when the boat is again started the propeller having been moved to the reference position which is a positive pitch is able to at least provide drive to enable the boat to get home. At step 804 the motor controller 22 is switched off, and at step 805 another check is made to determine whether the ignition 39 is actually off. If the ignition is off, the routine just cycles back to step 804 maintaining the control unit 22 in the off condition. Because the ignition (or fuel in the case of diesel engines) is switched off, the engine also has stopped. If the ignition in fact was not turned off, and the initial off signal was due to a spike or other short duration loss of power, the system resets itself at step 806.

In still further embodiments of the invention (not shown) the system may include a set speed cruise control mode where the boat can be placed into a set speed cruise control so that the boat continues to move at a predetermined speed over ground set by the cruise control mode until overridden by the driver. In the set speed cruise control mode, the speed of the boat is monitored by the GPS system 35 with a view to maintaining constant speed by the controller 10 adjusting the pitch of the propeller to a predetermined pitch, and then adjusting engine power to maintain the predetermined speed which has been set.

In the embodiment previously described, when an actual watercraft over the ground speed is required, this is obtained by using the data from the GPS system as previously described, or from any other suitable speed sensing or measuring device. However, in an alternative embodiment, watercraft speed can be provided from a look-up table. The look-up table can provide a number of speed values for a given propeller rotation speed and amount of pitch. As previously mentioned, the propeller speed is a function of engine speed and is dependent on the transmission ratio in the system which is usually 2:1. Thus, the propeller speed can be given by simply halving the engine rpm in this example. The amount of pitch provided is also measured by the Hall sensor device 30 previously mentioned. Thus, the amount of pitch and propeller rotation speed can be determined and an appropriate speed value selected from the look-up table. The speed value may be approximated for a given propeller speed and amount of pitch in a number of different ways. One way is to use the following equation to provide the approximation of the various speeds for given pitch and propeller speed values:

$$\text{speed}=\text{pitch}\times\text{propeller speed}-\text{slip}$$

The slip is a known quantity generally associated with a particular propeller design and can be determined or known based on the propeller which is being used. A typical amount of slip of the propeller is in the order of 25% of the speed value which will be given simply by multiplying the amount of pitch by the propeller speed. For this value, the speed value can equate to amount of pitch multiplied by propeller speed divided by ¾. If other values for slip are required, then the pitch multiplied by propeller speed is simply reduced by the amount of slip of the propeller 14. In the preferred embodiment, the desired operating characteristic is to maintain the amount of pitch constant and vary engine speed to obtain the required operating characteristics. If increase or decrease of engine speed is not able to obtain the characteristics, then the pitch is altered and the engine speed accordingly adjusted to provide the required speed of the watercraft.

In the claims which follow and in the preceding description of the invention, except where the context requires otherwise due to express language or necessary implication, the word "comprise", or variations such as "comprises" or "comprising", is used in an inclusive sense, ie. to specify the presence of the stated features but not to preclude the presence or addition of further features in various embodiments of the invention.

Since modifications within the spirit and scope of the invention may readily be effected by persons skilled within the art, it is to be understood that this invention is not limited to the particular embodiment described by way of example hereinabove.

The invention claimed is:

1. A system for controlling the pitch of a controllable pitch marine propeller of a watercraft having an engine, comprising:

a drive actuator for manual movement by a watercraft operator of the watercraft; a controller for controlling engine power and pitch of the marine propeller;

a mode selector for selecting a cruise mode or a maneuvering mode for the watercraft; and wherein the controller is also for receiving control signals from the mode selector and from the drive actuator, and when the mode selector is actuated to place the watercraft in the maneuvering mode, the controller limits engine rpm speed to within a predetermined value less than maximum engine speed and controls the pitch of the propeller blades in accordance with the manual movement of the drive actuator by the watercraft operator to change watercraft speed, and when the mode selector is in the cruise mode, the controller sets engine power up to the maximum engine speed and propeller pitch in accordance with movement of the drive actuator by the watercraft operator to change watercraft speed.

2. The system of claim 1 wherein the controller when in the maneuvering mode maintains engine speed substantially constant at a speed equal to or less than the said predetermined limit.

3. The system of claim 2 wherein the system includes a sensor for providing a measure of the pitch of the propeller blades, the sensor being coupled to the pitch control unit so the pitch control unit is provided with a signal indicative of the pitch of the propeller.

4. The system of claim 2 wherein the pitch control unit, when the pitch check-engine check mode switch is actuated, causes the clutch to open so that drive is not supplied from the engine to the propeller and in the engine check mode position, the pitch control unit outputs a signal to the engine to cause the engine to rev in accordance with the position of the drive actuator, as controlled by the watercraft operator, and when in the pitch check mode position, causes a signal to be output to the pitch motor controller and then to the pitch motor to adjust the pitch of the propeller dependent on the movement of the drive actuator.

5. The system of claim 4 wherein the pitch control unit includes a look up table of values for output to the pitch motor controller dependent upon the position of the drive actuator so that an appropriate value is selected for supply to the pitch motor controller to in turn control the pitch motor to adjust the pitch of a propeller to a position dependent on the position of the drive actuator.

6. The system of claim 1 wherein the controller when in the maneuvering mode adjusts the engine speed whilst also adjusting the pitch of the propeller.

7. The system of claim 1 wherein the predetermined limit is about 30% of maximum engine speed.

8. The system of claim 1 wherein the controller comprises a pitch control unit which controls engine power by selecting an output for supply to the engine from a look up table dependent upon the manually adjusted position of the drive actuator, and a pitch motor controller for receiving outputs from the pitch control unit to adjust the pitch of the propeller.

9. The system of claim 1 the system includes a pitch control motor for adjusting the pitch of the propeller and the pitch motor controller is for supplying an output signal to the pitch control motor to actuate the pitch control motor to adjust the propeller to the desired pitch.

10. The system of claim 9 wherein the engine includes an rpm sensor for sensing engine speed, the rpm sensor being connected to the pitch control unit.

11. The system of claim 10 wherein a speed measuring device is provided and connected to the pitch control unit for supplying a signal indicative of the speed of the watercraft to the pitch control unit.

12. The system of claim 11 wherein the speed measuring device is a GPS speed measuring system.

13. The system of claim 1 wherein the watercraft includes a clutch for selectively disconnecting power from the engine to the propeller or enabling power to be supplied from the engine to the propeller, a clutch actuator connected to the clutch and the pitch control unit being for supplying a control signal to the actuator to open or close the clutch.

14. The system of claim 13 wherein the system includes a clutch position monitoring sensor for providing a signal indicative of whether the clutch is in the open or closed position, the sensor being connected to the pitch control unit.

15. The system of claim 1 wherein the controller determines watercraft speed from a look-up table so that for particular pitch amounts and propeller rotation speeds, an appropriate speed value is provided.

16. The system of claim 15 wherein the watercraft speed is approximated from the equation: speed=pitch amount×propeller rotation speed−slip.

17. The system of claim 1 wherein the mode selector comprises at least one switch for selectively placing the watercraft into the maneuvering mode or the cruise mode.

18. The system of claim 17 wherein a second switch is provided for placing the watercraft into a pitch check mode or an engine check mode.

19. The system of claim 18 wherein the switches are momentary contact switches to place the system in the cruise mode or maneuvering mode, and the pitch check mode or engine check mode by causing modes to toggle between the cruise mode and maneuvering mode, and pitch check mode and engine mode.

20. The system of claim 1 wherein the system includes a clutch engage actuator for actuation by the watercraft operator so the pitch control unit can be overridden if attempting to open the clutch to maintain the clutch in a closed position so power is delivered from the engine to the propeller.

21. The system of claim 1 wherein the system includes a propeller stop element for actuation by the watercraft operator to perform an emergency stop of the propeller, the propeller stop element being connected to the pitch control unit so that upon actuation of the propeller stop element, the pitch control unit reduces engine speed and opens the clutch to shut off rotary power from the engine to the propeller, and adjust the position of the propeller to neutral position.

22. The system of claim 1 wherein the drive actuator is a control lever moveable between a full forward position to a full reverse position.

23. A method of controlling the pitch of a controllable pitch marine propeller of a watercraft which has an engine, comprising the steps of:

providing a cruise mode in which engine power and propeller pitch position is adjusted by manual operation of a drive actuator so the engine power is increased or decreased to drive the watercraft by rotation of the propeller and adjusting of the pitch of the propeller to achieve a required watercraft speed, the engine speed being adjustable up to a maximum engine speed;

providing a maneuvering mode in which engine speed is limited to less than the maximum engine speed and propeller pitch is adjusted by manual control of a drive actuator by the watercraft operator to enable the boat to be maneuvered by pitch control of the propeller which varies the speed of the watercraft; and providing a transition mode so that when the mode is changed from the cruise mode to the maneuvering mode, or from the maneuvering mode to the cruise mode, engine speed and propeller pitch are not changed in an undesirable fashion upon change between the modes if the location of the manually controlled drive actuator is in such a position which would otherwise cause the watercraft to respond in an undesirable manner.

24. The method of claim 23 wherein a single drive actuator is provided for changing watercraft speed when in the cruise mode, and changing propeller pitch when in the maneuvering mode.

25. The method of claim 23 wherein the transition mode determines whether the drive actuator position is beyond a predetermined limit and sets a predetermined engine speed and adjusts the pitch of the propeller dependent upon watercraft speed.

26. The method of claim 23 wherein the transmission mode still further comprises preventing the watercraft from operating in maneuvering mode and in such time as the drive actuator is manually adjusted by the watercraft operator to a position which matches engine speed and pitch of the propeller and thereafter continued movement of the drive actuator enables the watercraft operator to drive the watercraft in cruise mode by movement of the drive actuator.

27. The method of claim 23 wherein the step of providing the maneuvering mode maintains engine speed substantially constant at a speed equal to or less than the said predetermined limit.

28. The method of claim 23 wherein the step of providing the maneuvering mode comprises adjusting the engine speed whilst also adjusting the pitch of the propeller.

29. The method of claim 23 wherein the predetermined limit is about 30% of maximum engine speed.

* * * * *